US007086545B2

(12) United States Patent
Mannion et al.

(10) Patent No.: US 7,086,545 B2
(45) Date of Patent: Aug. 8, 2006

(54) SUSPENDED CONTAINERS

(75) Inventors: Jeffrey T. Mannion, South Burlington, VT (US); Christen A. Bear, Chicago, IL (US); John N. Williams, Boston, MA (US); Sue A. Williams, Gloucester, MA (US)

(73) Assignee: Ajava Pinata, L.L.C., South Burlington, VT (US)

( * ) Notice: Subject to any disclaimer, the term of this patent is extended or adjusted under 35 U.S.C. 154(b) by 27 days.

(21) Appl. No.: 10/622,005

(22) Filed: Jul. 16, 2003

(65) Prior Publication Data

US 2004/0105917 A1 Jun. 3, 2004

(51) Int. Cl.
*A47F 5/00* (2006.01)
*B65D 45/32* (2006.01)

(52) U.S. Cl. ..... 211/181.1; 211/183; 211/113; 220/319; 220/257.2

(58) Field of Classification Search ..... 211/181.1, 211/183, 113; 220/220, 319, 320, 254.7, 220/212, 255.1, 260, 257.1, 796, 258.1, 375, 220/212.5, 276, 359.2, 270, 269, 780, 783, 220/787, 790, 793, 254.3, 712, 713, 719, 220/731

See application file for complete search history.

(56) References Cited

U.S. PATENT DOCUMENTS

| | | | |
|---|---|---|---|
| 2,194,898 | A | 3/1940 | Hanford |
| 2,262,360 | A | 11/1941 | Gottlieb |
| 2,353,853 | A | 7/1944 | Sayford |
| 2,793,901 | A | 5/1957 | Johnson |
| 2,980,277 | A | 4/1961 | Ganz et al. |
| 3,119,541 | A | 1/1964 | Lynn |
| 3,397,814 | A | 8/1968 | Zackheim |
| 3,401,827 | A | 9/1968 | Messina |
| 3,415,404 | A | 12/1968 | Robinson |
| 3,434,620 | A | 3/1969 | Laurizio |

(Continued)

FOREIGN PATENT DOCUMENTS

| | | |
|---|---|---|
| DE | 3149663 | 10/1982 |

(Continued)

OTHER PUBLICATIONS

Color photograph of Nail Container.

(Continued)

*Primary Examiner*—Jennifer E. Novosad
(74) *Attorney, Agent, or Firm*—Fish & Richardson P.C.

(57) ABSTRACT

A support for a predetermined container having a rim e.g. at its top opening, the support comprising a lid or a supporting ring, constructed to interfit e.g. with the rim of the container, wherein there is a suspender, formed with the lid or supporting ring and deflectable from an as-formed position to an upstanding position in which it is capable of carrying weight of the container. In most cases suspenders extend inwardly of a rim of the lid or supporting ring. Free-ended flexible finger suspenders of synthetic resin, are shown, formed integrally with the lid or supporting ring as a molded unit. The lids or rings are associated with closure surfaces, such as closure portions molded with the lid or ring, closure inserts, or closure films or foils on the container itself. The suspenders are useful to the consumer in enabling improved carrying of the merchandise with other items or in intertwined fusion with the like items, and to the storekeeper in suspending merchandise. Combinations of the lids or supporting rings with containers containing prepackaged food, tennis balls and other contents, are displayed by storekeepers from hooks and racks, in many cases hanging at a substantial tilt angle for better visibility and utilization of stocking space.

61 Claims, 31 Drawing Sheets

U.S. PATENT DOCUMENTS

| | | | |
|---|---|---|---|
| 3,494,500 | A | 2/1970 | Foster |
| 3,631,021 | A | 12/1971 | Sinkula |
| 3,635,367 | A | 1/1972 | Morita et al. |
| 3,737,069 | A | 6/1973 | Owen |
| 3,752,305 | A | 8/1973 | Heyne |
| 3,908,948 | A | 9/1975 | Hawthorne |
| 3,931,948 | A | 1/1976 | Mason, Jr. |
| 3,973,689 | A | 8/1976 | Sutch |
| 3,979,012 | A | 9/1976 | Arfert et al. |
| 4,093,169 | A | 6/1978 | Winchell |
| 4,096,963 | A | 6/1978 | Rumball |
| 4,165,814 | A | 8/1979 | Seel |
| 4,211,336 | A | 7/1980 | Helms |
| 4,230,659 | A | 10/1980 | Sutch |
| 4,238,047 | A | 12/1980 | Helms et al. |
| 4,331,256 | A | 5/1982 | Helms |
| 4,333,569 | A | 6/1982 | Hammacher |
| 4,347,930 | A | 9/1982 | Herrin |
| 4,360,121 | A | 11/1982 | Helms |
| 4,412,624 | A | 11/1983 | Tanaka |
| 4,434,908 | A | 3/1984 | French |
| 4,438,864 | A | 3/1984 | Helms |
| 4,448,345 | A | 5/1984 | Helms |
| 4,453,646 | A | 6/1984 | Harrild |
| 4,456,146 | A | 6/1984 | Helms |
| 4,467,938 | A | 8/1984 | Allen |
| 4,505,390 | A | 3/1985 | Kirk, Jr. |
| 4,529,100 | A | 7/1985 | Ingemann |
| 4,702,387 | A | 10/1987 | Wombold |
| 4,712,671 | A | 12/1987 | Salacuse |
| 4,756,442 | A | 7/1988 | Halm et al. |
| 4,830,214 | A | 5/1989 | Curliss et al. |
| 4,854,466 | A | 8/1989 | Lane, Jr. |
| 4,897,032 | A | 1/1990 | Corteggiani |
| 4,899,882 | A | 2/1990 | Benner |
| 5,007,231 | A | 4/1991 | Ingemann |
| 5,020,686 | A | 6/1991 | Dutt |
| 5,025,942 | A | 6/1991 | Lucas |
| 5,037,595 | A | 8/1991 | Kornelis |
| 5,054,642 | A | 10/1991 | Yoshida |
| 5,065,880 | A | 11/1991 | Horner |
| 5,072,909 | A | 12/1991 | Huang |
| 5,111,961 | A | 5/1992 | Van Melle |
| 5,115,934 | A | 5/1992 | Nelson |
| 5,137,210 | A | 8/1992 | Hibbs |
| 5,148,973 | A | 9/1992 | Zimmermann |
| 5,156,273 | A | 10/1992 | Mortensen |
| 5,167,354 | A | 12/1992 | Cohanfard |
| 5,205,430 | A | 4/1993 | Valyi |
| 5,205,473 | A | 4/1993 | Coffin, Sr. |
| 5,205,477 | A | 4/1993 | Zimmermann |
| 5,238,135 | A | 8/1993 | Landis |
| 5,244,113 | A | 9/1993 | Stymiest |
| 5,246,133 | A | 9/1993 | James |
| 5,294,015 | A | 3/1994 | Landis |
| 5,301,827 | A | 4/1994 | Valyi |
| 5,305,931 | A | 4/1994 | Martin et al. |
| 5,361,935 | A | 11/1994 | Sagucio |
| 5,377,861 | A | 1/1995 | Landis |
| 5,398,843 | A | 3/1995 | Warden et al. |
| 5,427,259 | A | 6/1995 | Krastanov |
| 5,427,266 | A | 6/1995 | Yun |
| 5,454,497 | A | 10/1995 | Kettelson |
| D367,818 | S | 3/1996 | Zana |
| 5,511,360 | A | 4/1996 | Bakker et al. |
| 5,511,680 | A | 4/1996 | Kinne |
| 5,511,754 | A | 4/1996 | Johannsen |
| 5,518,314 | A | 5/1996 | Kawafuchi et al. |
| 5,538,154 | A | 7/1996 | Von Holdt |
| 5,609,894 | A | 3/1997 | Rathbun |
| 5,622,208 | A | 4/1997 | Vinson |
| 5,647,501 | A | 7/1997 | Helms |
| 5,660,301 | A | 8/1997 | Kaplowitz |
| 5,669,549 | A | 9/1997 | Robertson |
| 5,713,484 | A | 2/1998 | Setty |
| 5,725,120 | A | 3/1998 | Ramsey et al. |
| 5,806,710 | A | 9/1998 | Shiffer et al. |
| 5,873,482 | A | 2/1999 | Conti |
| 5,911,334 | A | 6/1999 | Helms |
| 5,927,496 | A | 7/1999 | Seaton et al. |
| 5,988,426 | A | 11/1999 | Stern |
| 6,015,470 | A | 1/2000 | Treleaven et al. |
| 6,053,353 | A | 4/2000 | Helms |
| 6,056,144 | A | 5/2000 | Stange et al. |
| 6,070,755 | A | 6/2000 | Evans et al. |
| 6,106,261 | A | 8/2000 | von Holdt |
| 6,142,334 | A | 11/2000 | Kristensson |
| 6,179,166 | B1 | 1/2001 | Dallas, Jr. |
| 6,196,451 | B1 | 3/2001 | Helms |
| 6,209,710 | B1 | 4/2001 | Mueller et al. |
| D469,020 | S | 1/2003 | Mannion et al. |

FOREIGN PATENT DOCUMENTS

| | | |
|---|---|---|
| DE | 3333565 | 4/1985 |
| DE | 3631021 | 3/1988 |
| DE | 3923463 | 2/1990 |
| DE | 3907365 | 9/1990 |
| DE | 29713186 | 1/1999 |
| EP | 0 535 869 | 3/1996 |
| FR | 2 698 529 | 6/1994 |
| FR | 2 745 798 | 9/1997 |
| FR | 2 745 800 | 9/1997 |
| GB | 2130184 | 5/1984 |
| GB | 2147566 | 5/1985 |
| GB | 2 251 431 | 7/1992 |
| GB | 2302531 | 1/1997 |
| JP | 4187111 | 7/1992 |
| JP | 5201465 | 8/1993 |
| JP | 9188338 | 7/1997 |
| JP | 11049231 | 2/1999 |
| JP | 11091786 | 4/1999 |
| JP | 11292101 | 10/1999 |
| JP | 2000189298 | 7/2000 |
| JP | 2000296840 | 10/2000 |
| KR | 200195745 | 9/2000 |
| WO | WO 96/26133 | 8/1996 |
| WO | WO 00/69736 | 11/2000 |
| WO | WO 01/28882 | 4/2001 |
| WO | WO 01/44058 | 6/2001 |
| WO | WO 01/50933 | 7/2001 |
| WO | WO 02/57154 | 7/2002 |

OTHER PUBLICATIONS

"Virgin connect with Braythorn", [retrieved on Jan. 4, 2002]. Retrieved from the Internet: <URL: http://www.braythorn.co.uk/home/virgin.htr>.

Commercial product: Molded bottle cap has laterally extending molded hole for suspending the bottle.

Commercial product: Composite end cap for a container (molded plastic ring and paper closure) has a pull ring. By following the directions "pull plastic ring around edge to open" the connection between the paper closure and the plastic ring is severed, to gain access to the container.

Commercial product: A lid for a container is formed by a plastic rim molded about a paper insert.

Commercial product: A bottle for intravenous fluid has a bottom-attachable molded ring by which the bottle can be suspended upside down, to deliver the fluid by gravity.

SUSPENDED CONTAINERS

This invention relates to disposable packaging, to sales displays, to improved techniques for carrying products in containers, to pre-packaged products, to take out consumable products, and to methods of manufacturing packaging.

This invention, in some aspects, employs concepts described in our pending applications U.S. application Ser. No. 10/052,210, filed Jan. 16, 2002, PCT Application Serial Number US02/01112, filed Jan. 16, 2002, published as WO 02/057154 A1 and PCT Application Serial Number US03/14175, filed May 6, 2003, the entire contents of each of which is hereby incorporated by reference in its entirety. In other aspects, the invention represents further advantageous features in the design, construction, handling and methods of making overcaps, lids and rings and relating them to disposable containers and the like.

INTRODUCTION TO THE INVENTION

The invention is based on a container that is supported by a suspending element provided by an overcap, lid or supporting ring. It provides to manufacturers, stores, restaurants, take-out counters, and customers a new form of packaging, display and means of transport. In many preferred forms the suspending element is so associated with the overcap or lid that the container, when suspended, hangs by gravity at a substantial angle. In many preferred embodiments the container that is associated with the suspending element has flexible walls and a thickened rim. The container may be a molded plastic can, cup or tube having an edge bead; it may be a conventional disposable paper or foam container, a coffee cup or a cup for cereal or soup having a rim bead; it may be a can (tin) of goods having a metal or plastic top and an outwardly protruding edge bead. It may be a composite container having a wall of e.g. helical wound paper substance or of blown plastic, in either case combined with a metal rim, peripheral bead or end closure. In many preferred forms, the overcap, lid or support ring with which the suspending element is integrated has a clear central section enabling view of the contents, or view of a tamper-evident seal. Particular embodiments of the invention have many other important features and uses.

According to one aspect of the invention, an overcap or lid for a container, or a support ring associated with the container, has an elongated finger suspender. In important embodiments the finger suspender is of plastic resin that is molded or otherwise formed integrally with the rim of the overcap, lid or the support ring. Such integral formation includes the suspender being formed as a monolith with the rim as the rim is formed or being preformed and bonded to the rim in the rim-forming step, as by insert injection molding. Other techniques of joining are also contemplated.

According to another aspect of the invention, suspending elements of a series of containers are constructed and arranged for one to be interfit into the opening of another, to enable units to be strung together for transport or display.

According to another aspect of the invention, a suspending element is located so off-center that the container, when supported by the suspender element, hangs at a marked tilt angle. In preferred embodiments of this feature, the product is hung from an elevated location, e.g. in unused high space in a retail store, and the tilt angle so situates the side of the container that it faces the customer due to the tilt of the container. The side of the container is readily noticed and identified by its printing. In another instance, the product is suspended below eye level, e.g. near the floor, and the tilt angle tilts the top of the container toward the customer for notice and ready reading of its brand and contents. In preferred embodiments, similar containers are suspended together, some tilted in one direction, others in another, such that they efficiently utilize presentation space, and their advertising is positioned to be read from various angles. In this way the containers may advantageously occupy space heretofore devoted only to products in flexible packaging such as cello or bubble wrapped products.

Another feature of the invention is a finger suspender which involves two finger-engageable openings in series along the suspender element, selectable for use in accordance with the user's preference. This embodiment takes account of the user's other needs for her or his hand, and the size of the container or string of containers being supported. In one embodiment of this aspect, a finger-engageable opening of the suspender is positioned to facilitate application of force to break a seal or bend back a portion of the lid or ring to facilitate its disengagement from the container. Another feature of the invention is the near-lying finger engageable opening per se, constructed to function as a finger suspender of an overcap lid or ring.

Another embodiment of the invention has two opposed finger suspender elements, each formed integrally with an overcap, lid or support ring arranged so that both suspender elements can be grasped by one or more fingers to lift the container. In preferred embodiments, the suspender elements lie in a single plane in nested fashion, extending from hinge roots at opposite sides of the rim of the overcap, lid or support ring.

The container filled with merchandise may be suspended in singles or multiples from a display rack. After purchase, the container may be supported by its suspender element by a finger leaving the hand free for additional activities, such as carrying a cup of hot coffee, a cold drink, a bag of popcorn, a plate of food, a briefcase, a tennis racket, a paint brush or a bag of groceries or leaving the hand still free for holding the hand of a child, parent or friend.

The container may be inexpensively constructed in accordance with this invention while providing for a variety of ornamental and distinctive appearances and trade dresses by surfaces that carry decoration and printing. The walls of the container can be printed to serve as holiday decoration or as a gift presentation. The shape of the container and its lid, their aspect ratios, configurations and colors may all be varied while remaining within the scope of the present invention.

A replaceable overcap, lid or support ring associated with a suspending element according to the invention may be removed from the container for partial consumption of the contents while remaining intact, available to be reattached to transport the left-over contents. In the home, the suspended containers may be placed in ordinarily unusable space, e.g. in waste space of a cabinet or a refrigerator. Suitable merchandise in the container includes pre-packaged chips, dried soups, cereals, spices, grains, legumes, dried fruits, cookies, crackers, coffee in bean or ground form, nuts, snacks, popcorn, candy, yogurt, ice cream, butter, frozen juice concentrate, cheese dips and condiments, and indeed all of the variety of goods ordinarily presented in cans or tins, including weighty food items, as well as hardware supplies, tennis balls, etc.

Certain embodiments include delicate products ranging from wrapped chocolate truffles to sets of small electric light bulbs. Preferably, with insulation features, a finger suspendable container may contain hot or cold contents such as hot soup, hot coffee, cold drinks, hot ready-to-eat foods, ice cream or yogurt, in single servings or larger quantities.

In many cases the invention includes tamper-evident features and vision access to the goods within the container, while in other cases retail establishments or their customers fill containers on-site.

Containers according to the invention can be efficiently displayed on single and multi-tier counter racks, tree displays or on horizontal or vertical lines of hooks. In some cases, in effect, the novel suspender containers can add another display row to a space-limited store, counter or kiosk. In many cases, embodiments of the invention enable presentation of cans, tubes and cup-form containers in places where they previously have not been considered suitable, e.g. suspended from display hooks, pegs, clips, display strips and in vending machines that were not intended for cups or cans.

According to a particular aspect of the invention, a disposable container with consumable contents is combined with a flexible finger suspender as described, the container being of greater than about 5 cm (2 inches) minimum horizontal dimension at its mouth, the container mouth engaged by a removable overcap, lid or support ring, the container having an upstanding wall of generally flexible material extending from a bottom to a wide mouth top, the container mouth being about as wide as the horizontal cross-section of the container, the wide mouth defined by a relatively thick rim formation, and the overcap, lid or support ring having a rim portion extending over and removably engaged with the rim formation of the container. The overcap, lid or support ring attached as by snap fit, are constructed to support the container and its contents, the flexible finger suspender being comprised of the material of the rim portion and being formed integrally with it, whereby the finger suspender enables the wide mouth container to be suspended for display and transport by the finger of a hand. In other cases, the finger suspender is pre-formed and joined to the overcap, lid or ring during forming of the latter. In such cases, the finger suspender may be of different material, from that of the main body of the closure.

Preferred embodiments of this aspect of the invention have one or more of the following features:

The finger suspender as formed, extends flat across the top of the container and is deflectable to an upright position about a flexible attachment root portion. Preferably, in many cases, the flexible root portion of the suspender is located in the rim region of the removable lid or supporting ring. In many cases the finger suspender has a length exceeding the radius or one half the lateral dimension of the rim of the container, in many preferred embodiments its length being about three fourths of that dimension or more.

The overcap, lid or support ring includes a rim of resilient plastic resin and the suspending element may be an integral extension from the rim, of the same resin, in a monolithic construction. In certain cases, preferably, the suspending element, as manufactured, lies, substantially in a plane coincident with or parallel to a plane of the rim, preferably within the confining planes of the rim. The suspender may reside in unstressed condition or be detained in a pre-stressed condition from which it can pop-up when released from detents or other means that retain it.

In important cases, the suspending element lies inwardly of the rim portion of the overcap, lid or support ring; for example, the suspending element extends inwardly as a flexible or deflectable integral projection from the rim to a free end which defines an opening sized to receive the finger, i.e. it forms a finger suspender. In other cases the suspending element lies outwardly of the rim, as a deflectable integral outward projection from the rim to a free end, which defines an opening sized to receive the finger, here again being a finger suspender. In still other cases, other suspending structures are employed, e.g. of bail form. In preferred cases, in important embodiments, the suspending element is in off-centered relationship to the overcap, lid or support ring so that the container hangs at a substantial angle. It is found that pairing of angled containers hanging in opposite directions can improve the utilization of hanging space in many instances, and as well, augment the visual effect.

According to another aspect of the invention, a combination is provided including a disposable container for consumable contents and a suspending element, the container being of greater than about 5 cm (2 inches) minimum horizontal dimension at its mouth, which is closed at least in part by a removable overcap or lid or is engaged by a support ring, the container having a wall of upstanding, generally flexible material extending from a bottom to a wide mouth at the top, the mouth being about as wide as the horizontal cross-section of the container, the wide mouth defined by a relatively thick or rigid rim formation, and the lid or suspension ring having a rim portion extending over and removably engaged in load-transmitting relation with the rim formation of the container, a single suspending element extending from and being formed integrally with the rim region of the overcap, lid or support ring, the suspending element being located to suspend the container at a tilted orientation.

In many implementations the container is of conventional molded plastic resin or resinous foam with integral sidewalls and bottom, or of paper stock such as drinking cup paper stock, for instance, coffee cup paper stock, or is of helically wound paper stock or of molded paper pulp, or is a blown or drawn or vacuum-formed plastic container. In such instances, the rim formation of the container advantageously comprises an outwardly protruding bead or a bead.

It is advantageous in many implementations that the plastic overcap, lid or support ring be snap-fit over a bead or other rim formation of the container in a joint sufficiently strong to support the container's weight. In other cases there is a folded rim associated with the container, as in the case of certain ice cream containers designed for friction fit of the lid telescoped over the container top.

In certain cases, the flexible wall of the container comprises plastic foam, and the rim formation of the container has a thickness of foam greater than lower portions of the container walls.

In many cases, the attachment of the lid to the container includes an outer heat shrunk plastic film band that forms a tamper-evident exterior seal. Preferably, the seal surrounds mating rim portions of the body of the container, adding to the strength and stability to the connection of the overcap, lid or support ring with the container.

Preferred embodiments of various aspects of the invention feature a finger-suspender or otherwise suspended overcap, lid or support ring, which has an open or clear section in its center through which the goods or a tamper-evident seal may be viewed. In certain embodiments, the overcap or lid comprises a colored or opaque outer rim and a central region of clear plastic. In other embodiments, it has a rim region and a central region integrally formed of clear plastic and a second colored or opaque rim member is attached to the clear plastic rim to render the composite rim region colored or opaque.

In certain implementations, the rim member of the overcap, lid or the support ring has a depending skirt that is heat-shrunk about the rim region of the container to form an exterior seal.

In other implementations, there is a clear plastic film member and an annular rim member, the clear plastic film member extending across the central portion of the lid to define a viewing window, and having a skirt that depends past, and is heat-sealed in the region of, an upper rim formation of the container.

Various embodiments of the invention are advantageously combined with a display rack or device on which the container can be suspended by its suspending element. The display rack or device defines a support, such as a rod, hook or clip on which multiple units of the container are displayed, hanging at angles, e.g. at an elevated position above the head of the consumer, or at a low position, e.g. near the floor, or at positions, e.g. at eye level, in which bags and flexible packaging have been previously thought more suitable than rigid or semi-rigid containers.

This invention, including the many detailed features that will be described, has many uses, and despite its simplicity, has not previously been known.

BRIEF DESCRIPTION OF THE DRAWINGS

FIG. 4 is a perspective view of a string of three containers similar to that of FIG. 1, the finger suspenders of the containers having been intertwined, while

FIG. 6 depicts a completed product while

FIGS. 8 and 8*a* are views similar to FIG. 7*a* of other overcap embodiments while

FIG. 12*b* shows the assembled container while

FIG. 13 shows a double ringed finger suspender, while

FIG. 17*a* illustrates the construction of FIG. 17 for a light load, that leaves the hand free for another function while

FIG. 18 is a cross-sectional view of a suspender unit-forming mold of clamshell type, for forming a suspender ring and sealing surface simultaneously while

FIGS. 20 and 20*a* are diagrammatic views of a molding system during stages of molding a suspender insert, while

FIG. 24*b* is a perspective view showing the finger suspender in distended position; while

FIG. 26 is a vertical cross-sectional view of a lid having a semi-circular handle 12 molded of the same resin as, and simultaneously with, the surrounding snap ring, being joined thereto by diametrically opposite hinge regions, while

FIGS. 31, 31' and 31*a* are top, partial vertical cross-section and perspective views of an overcap having an outside, centrally molded bail, while

FIG. 32 is a plan view and FIGS. 32*a* and 32*b* are perspective views of use of a first version of an overcap having undersurface perforations defining a finger suspender, while

DESCRIPTION OF PREFERRED EMBODIMENTS

Figure 1:
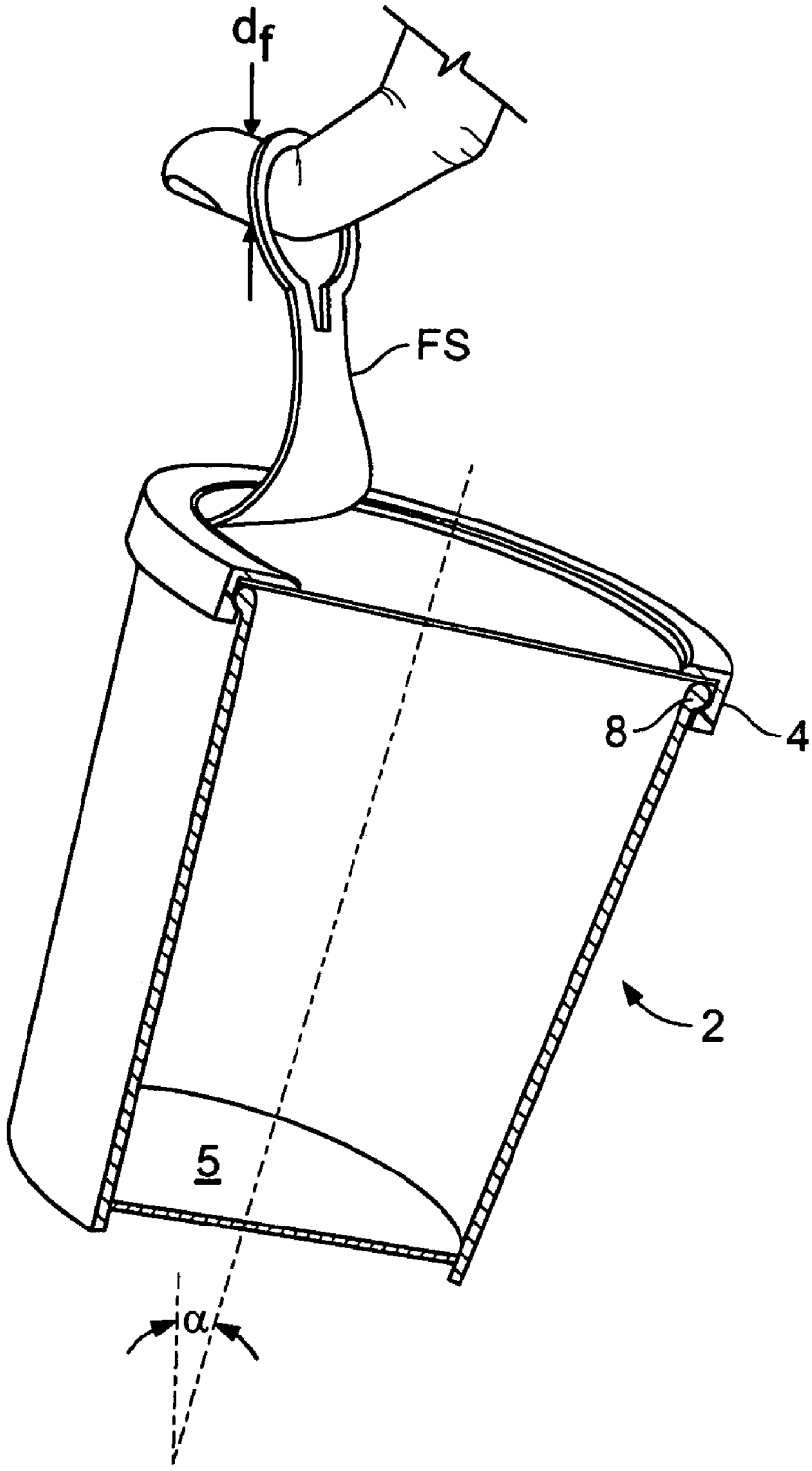
FIG. 1 is a cut away perspective view of an embodiment of the invention, while FIGS. 1*a* though 1*d* are, respectively, views of the supporting ring of FIG. 1 in plan, vertical cross-section, perspective as manufactured, and perspective in operable position.
Figure 1A:
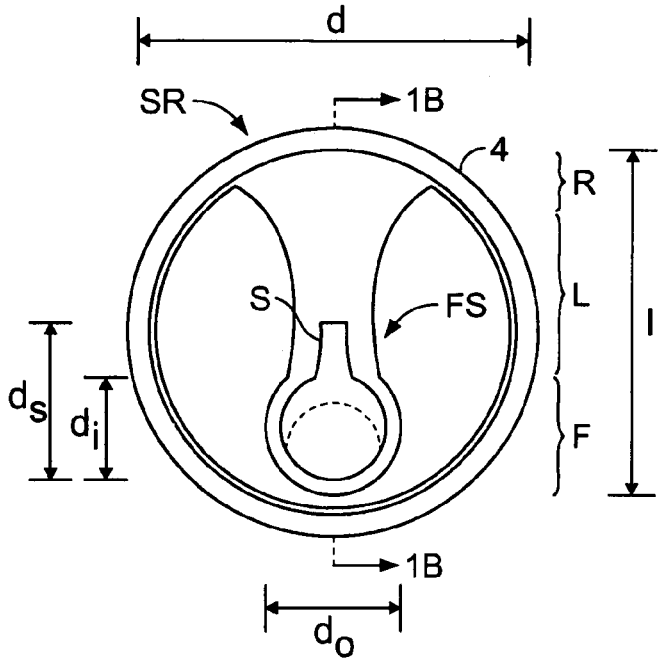
Figure 1B:
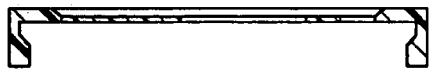
Figure 1C:
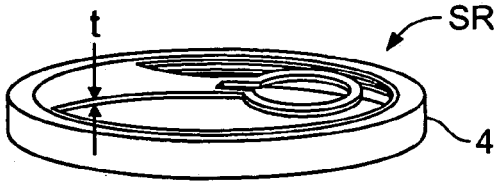
Figure 1D:
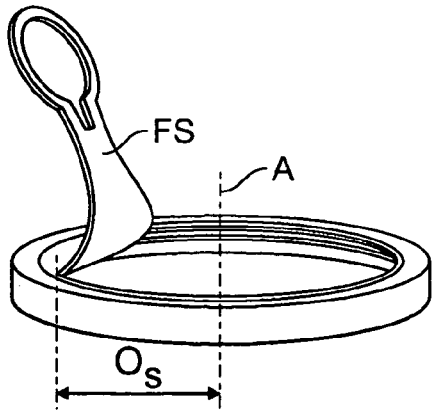

In FIGS. 1–1*d* are shown a suspending ring constructed to be snap-fit over a container 2 that has an outwardly extending bead 8 at its wide mouth, as in the manner of a conventional resilient overcap, molded of synthetic thermoplastic resin.

The suspending ring SR comprises rim 4 of the injection molded plastic resin having a circular downwardly extending formation adapted to snap over and engage the circular bead 8 of the container 2 in the usual manner of snap-over lids as used with disposable drinking cups, plastic containers, and cans or tins.

Integrally molded with the rim 4 is finger suspender FS, comprising an inward projection of the plastic resin having an over-all length 1, greater than the radius of the mouth of the container 2'. As shown it has a length 1 greater than 75% of the diameter of the mouth, and an overall length in excess of two inches. The over-all length 1 of suspender FS is comprised of a short root region R, a long leg portion L and a finger ring portion F. The finger suspender FS is flexible, in this embodiment being of sheet form of constant thickness. The short root region R is constructed to act as the principal load-bearing hinge. This hinge together with the extended length of the flexible suspender enables the suspender to be deflected, as shown, from a planar as-molded position, in which it lies parallel to and within the bounding planes P and $P_1$ of the molded rim of the support ring, to an upright position when under load as shown in FIGS. 1*a* and 1*d*.

The hinge location in the vicinity of the rim and the general flexibility of the suspender enables the container to rotate significantly due to significant off-set $O_S$ of the center of mass of the container from the center of lift of the suspender FS. Accordingly, the container tilts to the angle É, (degree of cant) with highly desirable consequences, explained below.

The tilt angle $\alpha$ may be selected by suitable selection of the width, thickness and length of elongated suspender SF and the physical properties of the chosen plastic resin, in relation to the size and weight of the filled container and the degree of tilt angle É desired. Polyethylene, polypropylene, polystyrene, and in general, thermoplastic resins having a degree of resilience, such as conventionally used to injection mold snap lids, are suitable materials.

The finger ring opening F has an inner diameter $d_i$ that exceeds the design dimension $d_f$ of a user's finger, enabling the container to be suspended by the finger as shown in FIG. 1.

The base of the finger ring opening F terminates in slot S, which contributes to defining an overall opening of length $d_s$ that is equal to or greater than the outer diameter $d_o$ of the head of the finger suspender. The purpose of this feature is described later in connection with FIGS. 4 and 4*a*.

Figure 2:
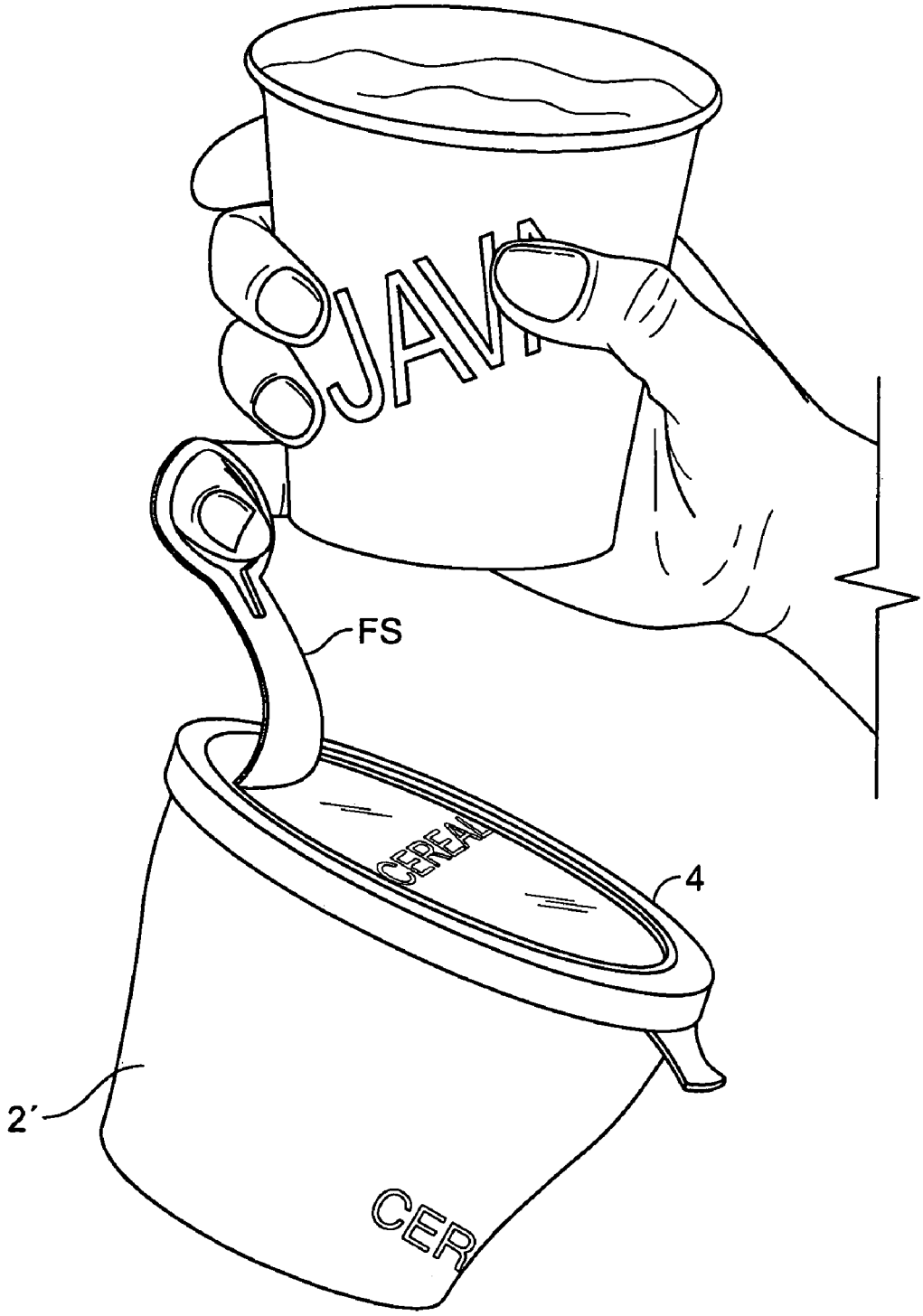
FIG. 2 is a perspective view of an embodiment of the invention suspended by a finger of a hand that also holds a cup.

Important advantages of the container associated with finger suspender FS of the support ring are illustrated in FIG. 2. Only one finger is used to support a full container of cereal as the user moves from a counter with a hot cup of coffee in the same hand. The relative location of the suspended container of cereal may be selected by the user, by selecting the tilt orientation of the container relative to the finger when initially lifting the container. This enables the container to be carried in the protected position, shown.

Figure 3:
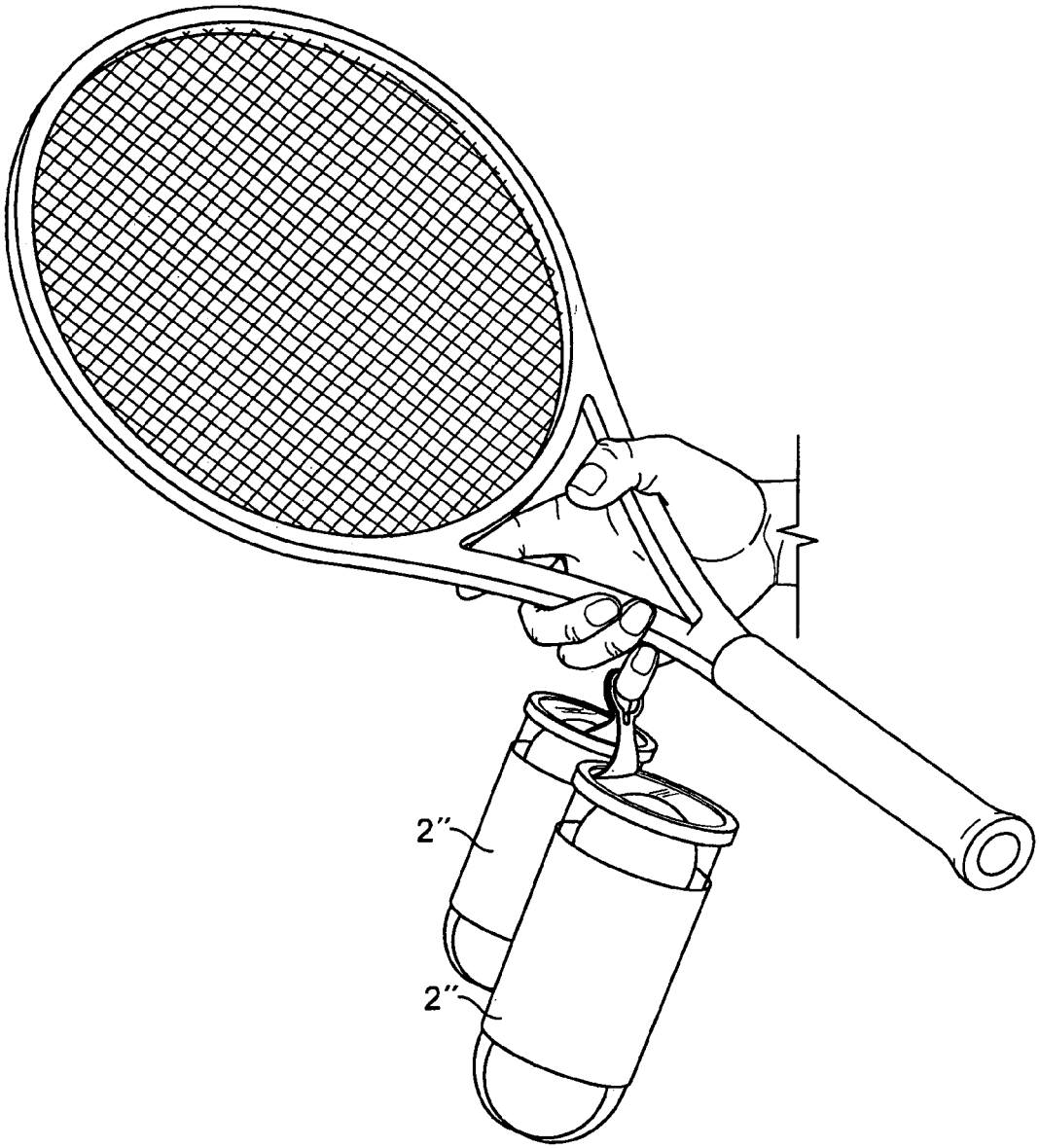
FIG. 3 is a perspective view of a tennis player transporting her or his racket by a hand, a finger of which suspends two cans of tennis balls according to the invention.

Support rings similarly applied to tennis ball cans 2", the rims of which are snapped over the metal outer ring of the can's conventional metal sealing lid, enables two cans of balls to be carried by a finger of the same hand that carries a tennis racket, FIG. 3.

In FIG. 3, the finger supports the rings of the suspenders of both cans. Alternatively, with suitable length, the suspenders of the cans may be intertwined so that only one finger ring needs to be lifted, using the feature now to be described.

Figure 4:
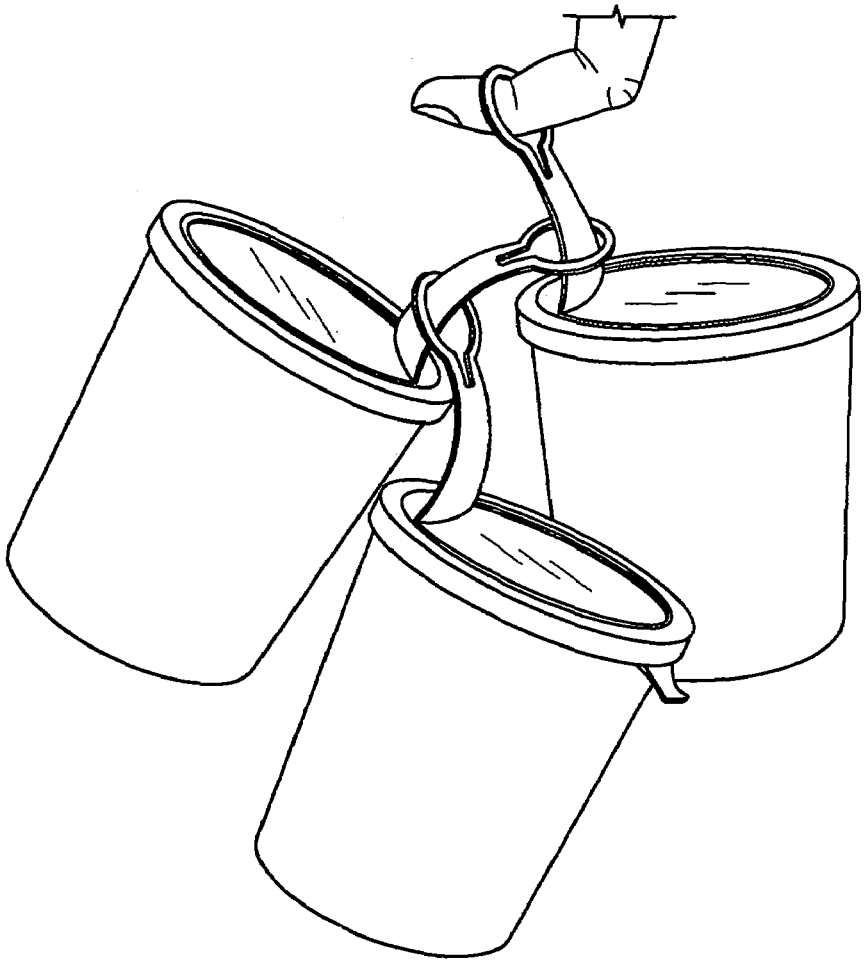

Referring to FIG. 4, the head of one finger suspender $FS_1$ attached to its container, is turned to register with slot S in the head of the suspender $FS_2$ mounted on the other container. By grasping the head of the first suspender, $FS_1$, pulling it through and engaging a finger in its ring, both tennis cans can be supported.

Figure 4A:
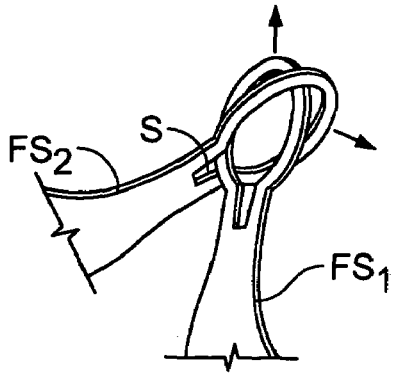
FIG. 4*a* depicts the intertwining action.

Indeed, as suggested in FIG. 4*a*, with the flexible suspenders of suitable length relative to the diameter of the containers, an intertwined string of three or more containers may be formed and supported by a single finger.

Note in FIG. 4*a*, how the tilt angle assumed by each container is made use of in enabling the suspended containers to nest compactly for convenience in transport.

Figure 5:
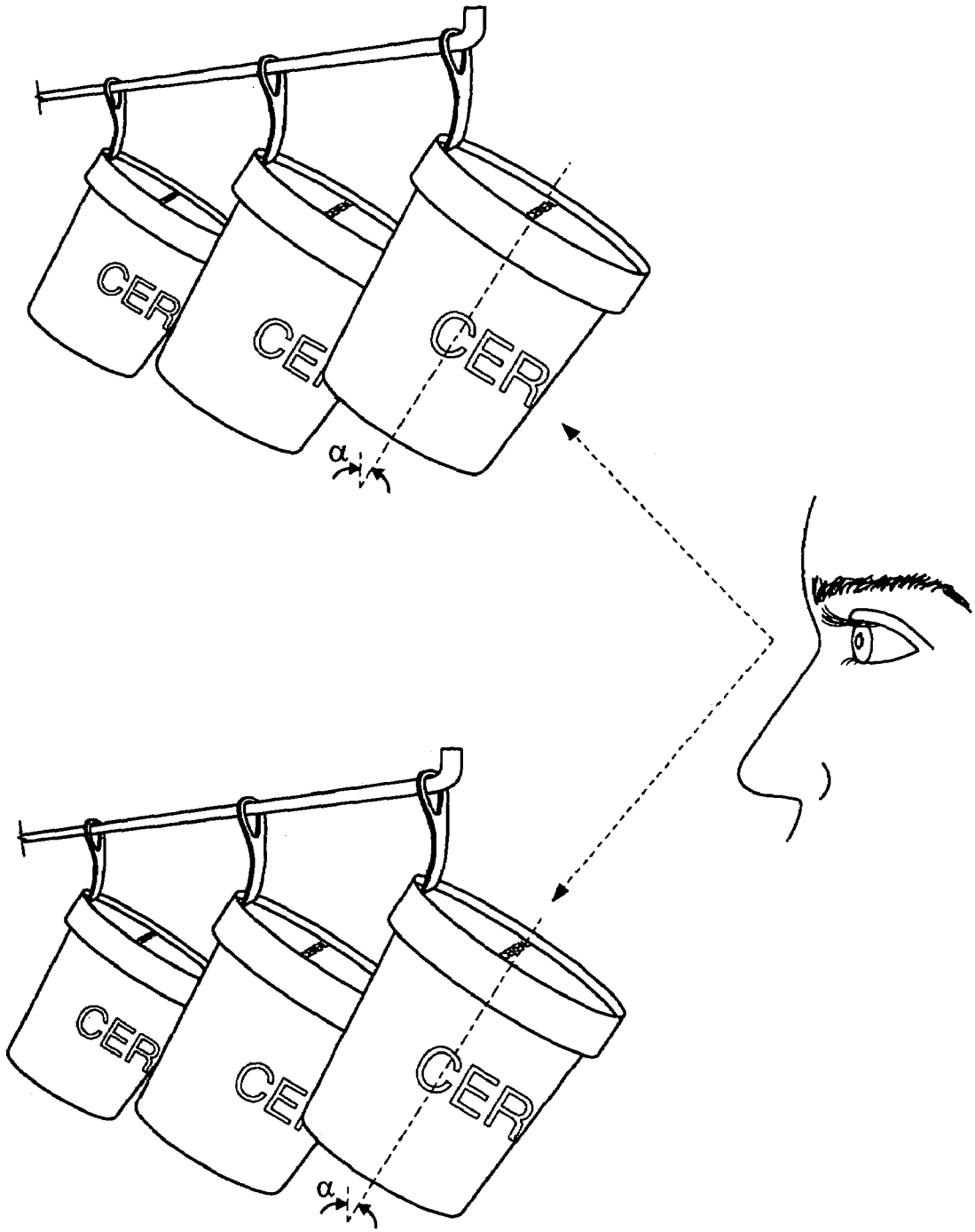
FIG. 5 is a perspective view of products suspended at an angle, some products suspended on racks located above the head and other products suspended at lower than eye level.

Referring to FIG. 5, the tilt angle É achieved by the present invention has important commercial display advantages. One needs to keep in mind that display space of a retail store, for instance, determines the variety and quantity of goods that may be presented. The tilt angle achievable by the off-center suspension described has an important advantage in allowing goods to be presented from high places at an angle that enables side labels to be readily noticed and read. Likewise, goods supported lower than eye level can be tilted by the act of suspension so that the label on the container lid may be readily read and the brand recognized. Similarly, by use of the finger suspenders, cups and tubes may be suspended for head-on viewing, most available for pickup, in space heretofore occupied mostly by flexibly wrapped products. Thus, the invention represents a contribution to point of purchase displays as well as to the convenience of transport, and enables more prevalent use of relatively rigid or semi rigid containers, tubes or cups, which contribute added to convenience to the user over flexibly packaged goods.

We note here that off-center loading of a somewhat elastic snap lid or the like may have appeared to others to be undesirable out of concern that the snap ring would be deformed and likely detach from the container. According to the invention it is found that a wide range of useful weight bearing is achievable before failure, by the features shown and by selection of the parameters of the substance and configuration of the resilient snap ring as well as the properties of the suspender discussed above. Weight bearing with a significant safety factor has been found to be readily achievable. With little expense, the strength of the integral finger suspender can be great enough to exceed the disengagement force by a factor of 2, 3 or more, as desired. Thus, the weight of the product can be carried and the suspender can also be used to apply a greater force to remove the rim from the container.

The embodiments of FIGS. 1–1*d*, 6–6*d*, 14, 15 and 16 may employ a conventional 8-ounce disposable paper beverage cup 2 having a rolled upper bead 8 and a snap suspending ring 4 or snap lid 4' based upon features of a conventional disposable thermoformed snap lid. Such a cup tapers, having, for instance, a minimum diameter of about 4.5 cm (1.75 inches) at its bottom and a maximum diameter of about 6.5 cm (2.5 inches) at its top, the mouth of the cup corresponding to the latter dimension. The ring or lid is of suitable plastic resin, e.g. of 0.5 mm thickness and the cup and rim or lid are cooperatively constructed to be snap-fit together, the rim portion of the ring or lid lying over and engaging outer bead 8 of the container. Likewise, the embodiments may employ a helically wound paper or chipboard container or a blown or drawn plastic tube.

The containers of FIGS. 1–1*d*, 6–6*d* 14, 15 and 16 may be sealed by a segment of cellophane sheet, clear polyester film or the like, that is adhered to the rim 8 of the container described later in relation to FIGS. 6–6*d*.

Figure 14:
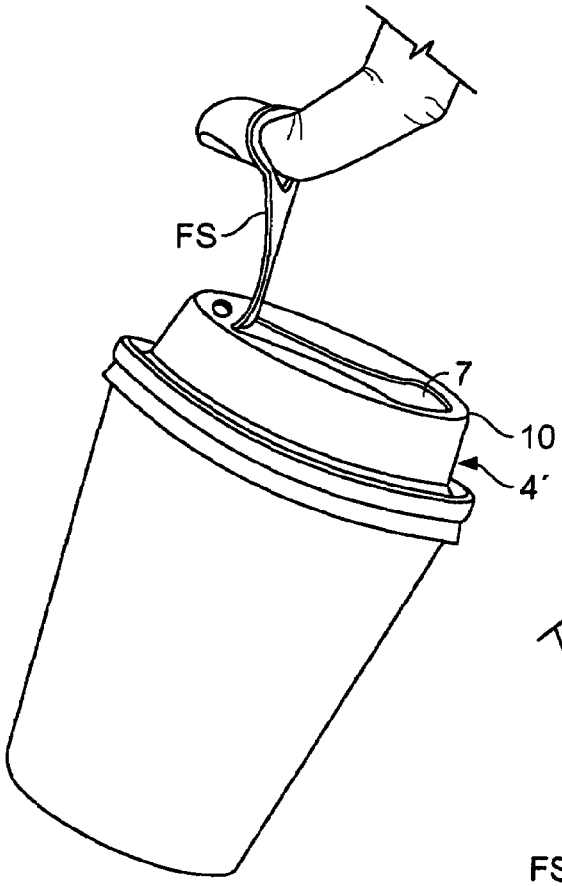
FIG. 14 illustrates a lid having an integral finger suspender formed by a free-ended integral inward projection from the rim of a snap-on lid.
Figure 16:
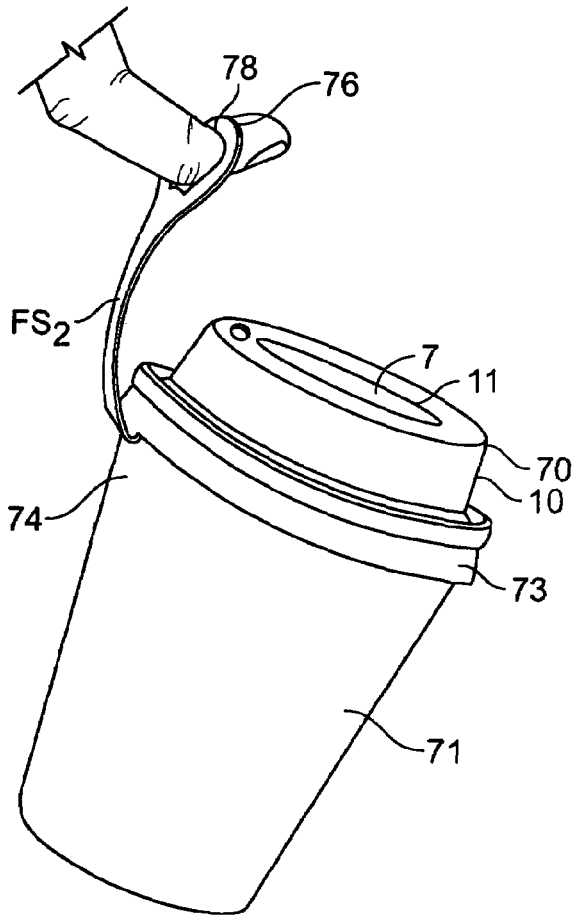
FIG. 16 illustrates a lid having an integral finger suspender element formed by a free-ended outward integral projection from the rim of a snap-on lid.

The lids shown in FIGS. 14 and 16 correspond to lids designed for hot beverage, formed of opaque, colored plastic. However, unlike conventional snap lids for beverage cups, the lid 4 of FIG. 16 has a round central opening terminating at edge 11, of diameter, e.g., of 4.25 cm. Inserted into the rim of the lid of FIGS. 14 and 16 and bonded in place to the undersurface of annular ridge 10 is a circular disk 7 of clear plastic resin, of diameter slightly smaller than the diameter of ridge 10, e.g. of 6 cm diameter. In each case, the clear sealing sheet segment provides a see-through window in the snap-lid.

Figure 6:
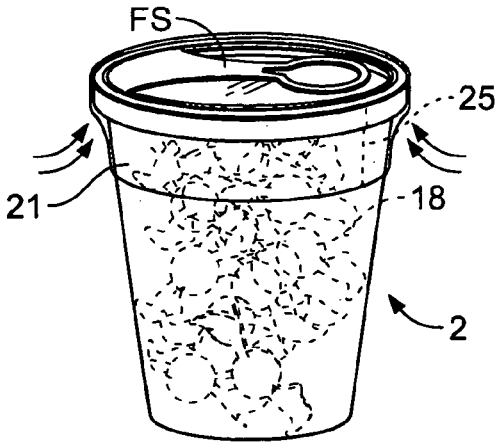
Figure 6A:
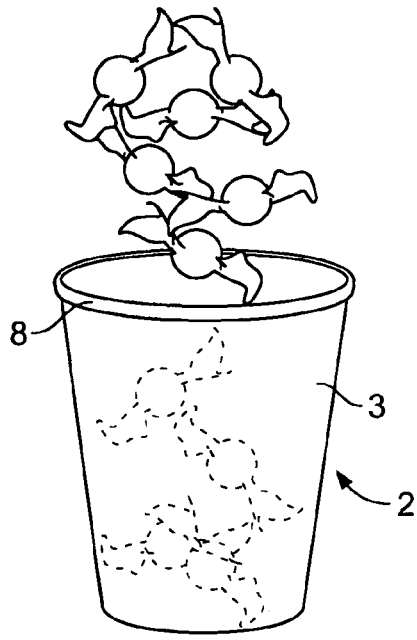
FIGS. 6*a*, 6*b* and 6*c* are sequential views showing the assembly of the product of FIG. 6.

As shown in FIG. 6*a*, the paper wall of a cup terminates in a relatively rigid upper bead 8, which defines the circular top rim of the cup. In the embodiments of FIGS. 14 and 16 the raised ridge 10 of the lid lies about 1 cm above the plane of the rim of the cup when the two are snapped together. The cup wall 3 is originally manufactured as flat paper stock and is printed with high accuracy in its flat form, to provide decoration, trade dress, notice of ingredients, etc. It is then cut, formed and glued in the usual way for beverage cups, into the truncated conical shape shown. In the usual way, the bottom of the cup is formed of a separate bottom member 5, to which an in-turned margin of the lower part of the side wall 3 is bonded. As is common with beverage cup lids, a series of spaced-apart inward indentations, not shown, are provided in the lower rim of thermoformed lid 4, located to snap over the cup's rim bead 8 to resiliently engage the lower portion of bead 8 to secure the lid to the cup.

One preferred product is the container of FIGS. 1, 6, 14, 15 or 16 pre-filled with delicate twist-wrapped chocolate mini-truffles 18 (chocolate shells with flavored soft gnoche centers). These are individually wrapped with metallized polyester wrapping film. As shown in FIG. 6, the free ends of the twisted truffle wrap, while flexible, have a degree of stiffness sufficient to cushion the truffles with each other and the inside walls of the container. As shown best in FIGS. 6*a* and 6*b*, inner layer 19 of clear plastic is adhered across the rim of the cup, providing an air seal and a tamper-evident feature.

Figure 6B:
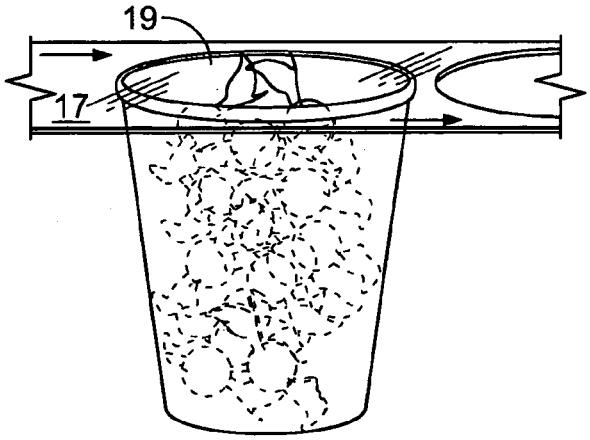
Figure 11:
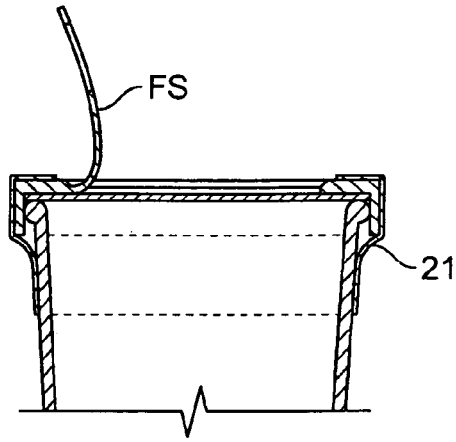

In certain preferred embodiments, an outer seal band 21, shown in FIGS. 6*b* and 11, is applied across the juncture of the lid or suspending ring and the cup. It serves both to add security and provide a tamper-evident feature. Seal member 21 is an annular preform of heat-shrinkable resin such as polyethylene or acetate, sized to encompass the joint region of the container. After the container is filled, heat is applied to the seal preform 21, causing it to shrink to tightly engage both the rim 4 of the lid, or ring and the wall of the cup 3 below its bead 8. As suggested by the dotted lines in. FIG. 6, a tear feature 25 is incorporated in the preform 21 and visibly identified. To gain access to the container, the user first breaks this seal and then lifts off the lid of the container. The tear feature may be of many known kinds, e.g., a vertical row of perforations, with or without a pull tab or pull string.

Figure 6C:
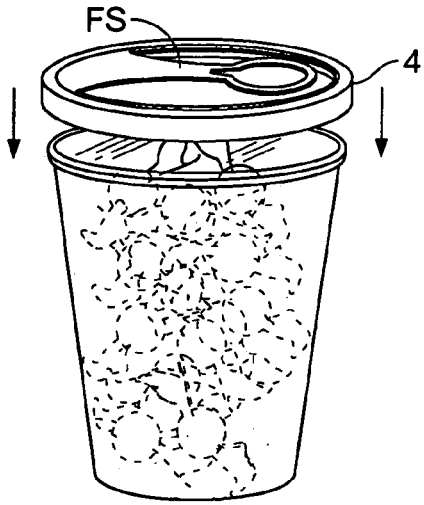

Referring to FIGS. 6*a* through 6*c*, the sequence of manufacture of a pre-packaged product is illustrated. Cup 2 is gravity-filled with the desired contents, in the example twist-wrapped chocolate mini-truffles, FIG. 6*a*. The filled container then has a moisture barrier adhesively applied to its outer rim of clear plastic sheet 17, which passes relatively over the cup to provide the tamper-evident film segment 19. To accommodate projection into that space of a circular ridge of the lid or rim when the lid is snap-fit onto the cup, the film may be formed with a downward indentation at the rim of the cup, or be yieldable in that region.

FIG. 6*c* shows the rim 4 of a suspending ring being applied to the filled and sealed cup which, for many products, completes the packaging. However, for the chocolate truffle product of FIG. 6, the seal preform 21 is positioned and exposed to heat H, as from a suitably shaped hot air appliance, which heat-shrinks the film band 21 to the conformation shown in FIG. 6. The band reinforces the interconnection between the rim 4 and cup 2. Such a seal can assure that a container and its contents can be suspended by the finger suspender during handling, even if the contents are heavy.

In certain embodiments, as where the contents of the container are of lightweight, the outer seal 21 may be omitted, while in other embodiments, as where protection of the goods does not require, the internal seal sheet 19 may be omitted.

The user gains access to the contents by rupturing the external seal 21, if present, and by grasping and pulling on the novel finger suspender with a force level considerably exceeding the weight of the package. The off-center relationship of the suspender to the rim 4 applies bending forces to the ring or lid, as the user firmly grasps and holds the cup steady. This action commences progressive disengagement from the rim bead 8 of the cup; indeed, in the case of a lid forming a hermetic seal, the lid may come off with the sound of a "pop." The user then removes the inner sealing film 19, if present, to gain access to the contents.

In certain preferred embodiments, the tear feature 25 is located on the periphery in alignment with the root hinge of the finger suspender FS. The two are thus cooperatively related, to enable a firm tug on the suspender to break outer seal 21 at its tear or break feature and remove the lid in one motion.

Selectable cost-effective features are combined with the suspender system to achieve the desired degree of sealing for freshness and security while permitting visibility of the product, or protection of the product from light or moisture, as desired.

Figure 6D:
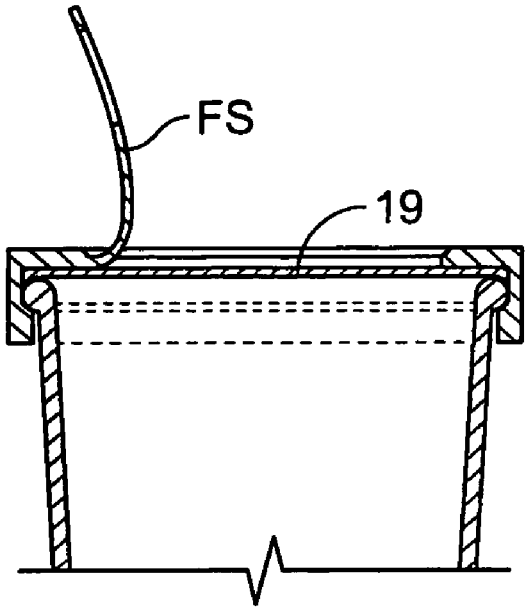
FIG. 6*d* is a vertical cross-section of the container of FIG. 6.

FIG. 6*d* illustrates that the clear film 19 or, in its place, foil or other opaque cover, can readily be sealed to the mouth of the container before application of the suspending rim by snap-fit over the container bead.

Figure 7:
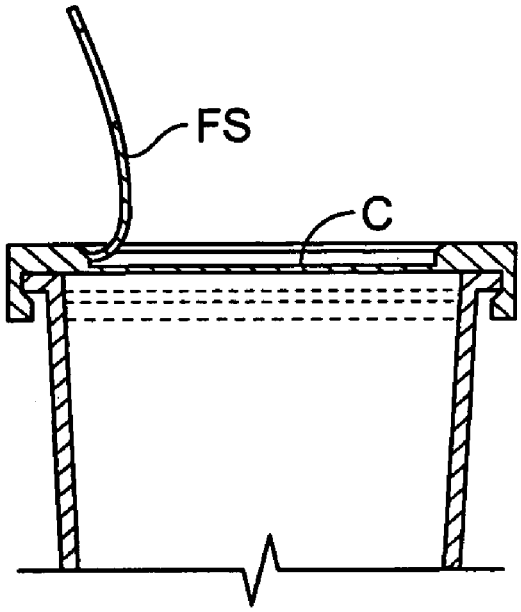
FIG. 7 is a vertical cross-sectional view of a further embodiment having a sealing feature, in the form of a resilient overcap.

In the embodiment of FIG. 7, a single-piece molded snap lid offers complete closure. The finger suspender FS is molded integrally with the rim at an upper level, while a separated mold cavity parallel with the suspender cavity but spaced below, extends continuously from one side of the rim to the other, to form closure membrane C.

Figure 7A:
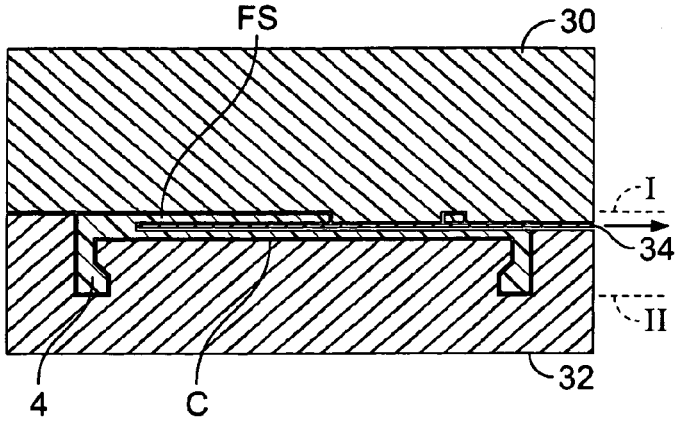
FIG. 7*a* is a cross-sectional view of a similar embodiment shown in the mold in which it is formed.
Figure 7B:
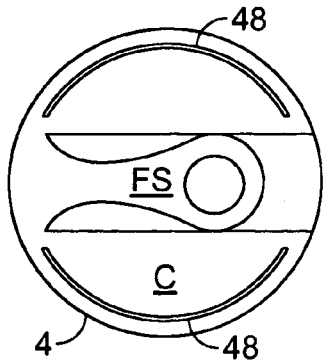
FIG. 7*b* is a top view of the overcap of FIG. 7*a* with its finger suspender lying in the plane of original formation, within the bounding planes I and II of the overcap rim.

In the embodiments of FIGS. 7*a* and 7*b* the finger suspender FS, which is a flexible sheet-form member as shown, is molded by use of a movable core element 34. In molding position, as shown in FIG. 7*a*, the core element 34 enables forming the planar central, liquid tight cover C integrally with the rim 4, independently of the spaced above, flexible finger suspender FS. The suspender, joined at its root to the molded rim of the overcap, lies just below the parting plane between upper and lower mold halves, 30 and 32. It is between the bounding planes I and II of the rim. The cover C lies lower, spaced from the finger suspender by the thickness of the core element 34. After the mold is filled and the piece solidifies, core element 34 is withdrawn laterally in the direction of the arrow, parallel to its plane of extent. When the core is fully retracted, the molded piece is ejected from the lower half of the mold.

As shown in FIG. 7*b*, the finger suspender FS lies in a central channel formed in the cover, in protected position for automated handling of the overcap. It can be retained in that position by small frangible runners. As can be understood from FIG. 7*a*, in the finished part, there is space, between the outer end of the finger suspender FS and molded cover C, in which one can insert a fingernail or finger to simply pry the suspender into a suspending position shown in FIG. 7.

Figure 8:
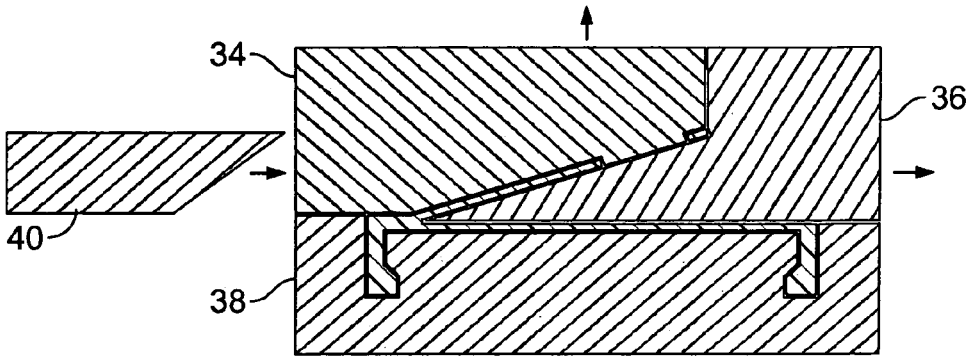
Figure 8A:
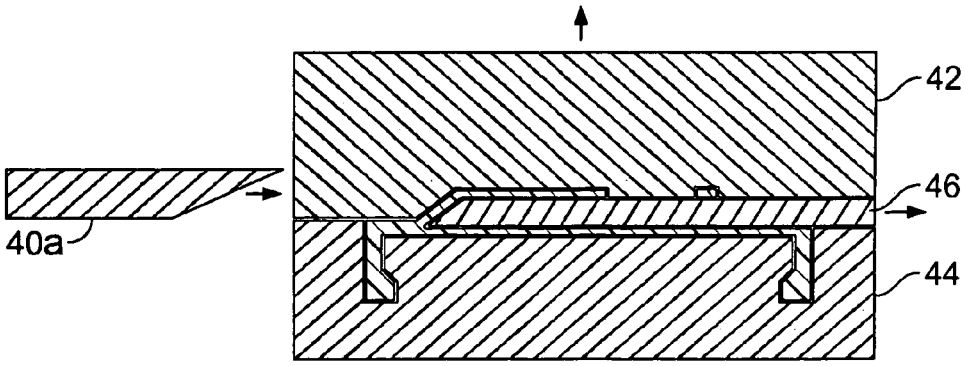
Figure 8B:
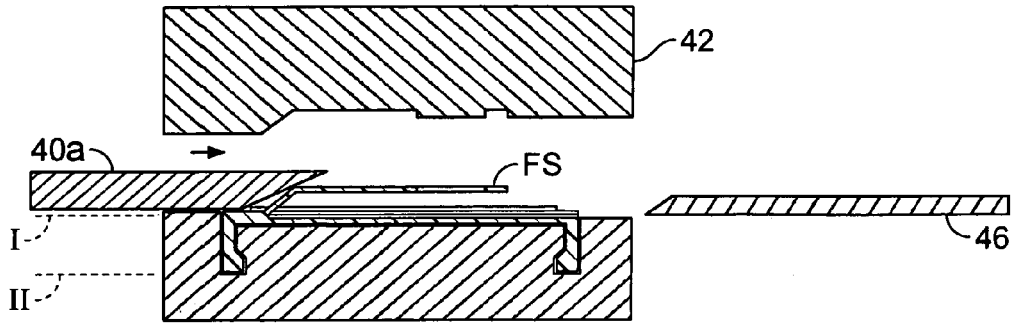
FIGS. 8*b* and 8*c* show the mold of FIG. 8*a* at different stages in the steps of manufacturing the overcap of FIG. 8*a*.
Figure 8C:
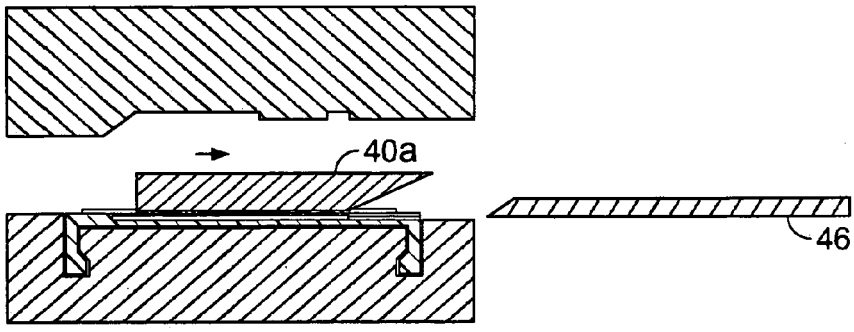
Figure 8D:
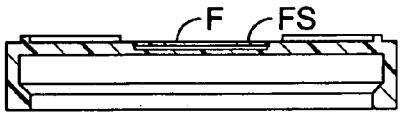
FIG. 8*d* is a vertical cross-section of the overcap of FIG. 8*a*, taken transversely to the axis of the elongated finger suspender of the overcap, with the suspender in pre-stressed but locked down position as the result of the final forming steps.
Figure 8E:
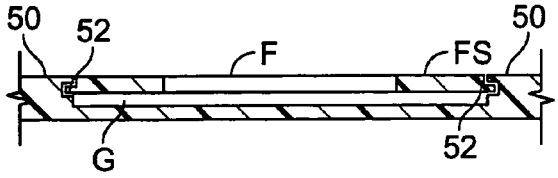
FIG. 8*e* is a magnification of a portion of FIG. 8*d*.
Figure 8F:
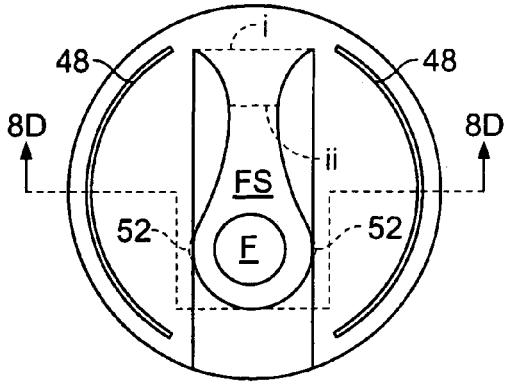
FIG. 8*f* is a top view of the finished overcap of FIG. 8*d*.

The embodiments of FIGS. 8 and 8*a* differ from the embodiments of FIGS. 7 and 7*a* in that, as initially molded, the finger suspender FS is not confined between the bounding planes I and II of the rim 4, in FIG. 8 the suspender extending at an acute angle, in FIG. 8*a*, the suspender beginning at such angle, then bending back to parallel with the rim but spaced from it. However, during further steps in its formation, after raising of mold half 34, 42, respectively, and withdrawal of the core element 36, 46, respectively, a wedge-form displacement member, 40, 40*a*, respectively, moves laterally over the top of the lower mold half in the direction of the arrows. By a wedging action it displaces the finger suspender downwardly to its final formed position. Either by virtue of a permanent "ironing" effect of the displacement member acting upon the still-warm molded resin, or by virtue of retention detents such as to be described, the final, as-manufactured position of the finger suspender FS is between the confining planes I and II as defined in respect of FIG. 7*a*. As a result, the embodiments of FIGS. 8 and 8*a*, too, are suitable for automatic or robotized handling of the overcaps, without concern that the suspenders will impede the action of cap feeders and other movements. FIGS. 8*b* and 8*c* depict successive positions of the displacement member 40*a* during its action on the finger suspender FS. As seen from FIGS. 8*d* and 8*f*, and more clearly in the magnified partial view of FIG. 8*e*, molded side projections 52 slightly protrude from the lateral sides of the finger suspender FS at its widest dimension at the finger hole F. By the wedging action of the displacement member 40*a*, these are forced downward to move past ledges 50 formed in the side walls of the channel into which the finger suspender has been pressed. Ledges 50 act as detents to hold the finger suspender in its depressed position between bounding planes I and II, overcoming any slight self-lifting tendency that may remain due to the original orientation of molding of the finger suspender. This lifting tendency can be taken advantage of in assisting the finger suspender in rising to useful position after being dislodged by a gentle upward force applied to the tip of the suspender by a finger, finger nail or simple prying device.

In the embodiments of FIGS. 7*b*, 8 and 8*a*, opposed stacking ring segments 48 are provided, covering most of a full circle, but interrupted at diametrically opposed positions to provide space to enable the lateral motion of the core element and the displacement member. The ring segments 48 are sufficient in extent to ensure reliable stacking of the overcaps in the usual way.

Figure 9:
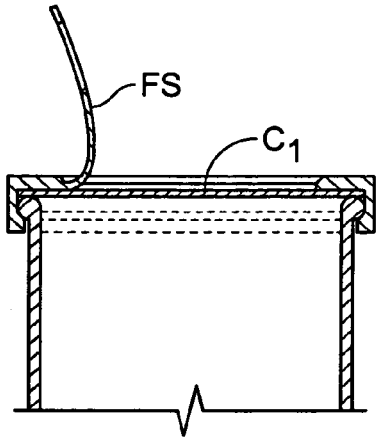
FIGS. 9, 9*a*, 10 and 11 are vertical cross-sectional views of further embodiments having sealing features.

In the embodiment of FIG. 9 a separate closure element $C_1$ is preformed, inserted into the suspending rim and joined, as by adhesive, to the underside of the rim. As shown, element $C_1$ is of diameter larger than the diameter of the container such the rim when snapped over the mouth of the container compresses the closure material $C_1$ between the suspension rim and the rim of the container to form a seal.

Figure 9A:
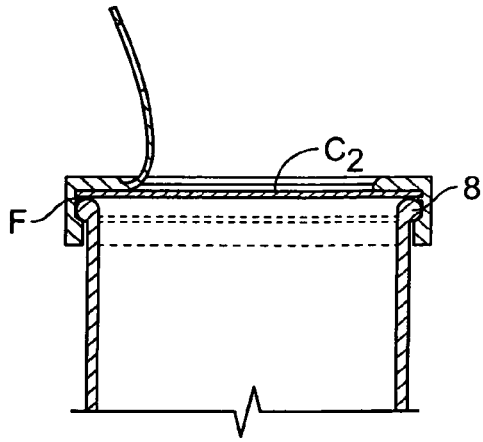

In the embodiment of FIG. 9*a*, an inwardly protruding supporting flange formation F is molded on the inside of the skirt of the suspending ring, thus defining a peripheral slot into which a preformed closure disc may be snapped and held secure. Again, the dimensions may be selected to cause the closure material $C_2$ to be compressed when the ring is snapped over the container bead 8.

Figure 10:
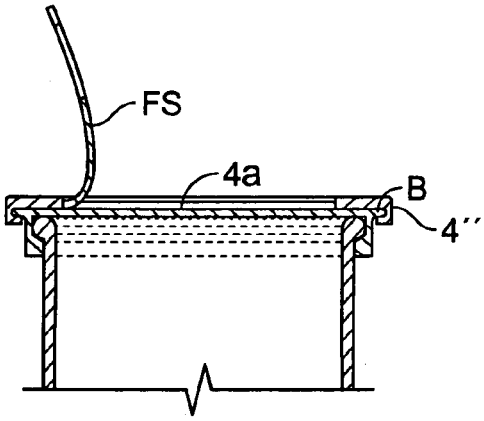

In the embodiment of FIG. 10, a snap-fit closure 4*a* of otherwise conventional form defines its own peripheral outer bead B. A suspending ring 4", which may otherwise be of the construction previously described, has a snap groove sized and arranged to snap-fit over bead B, so that desired closure and suspending functions are achieved by two parts that are snap-fit together. Two station automatic machinery can first snap the closure 4*a* on the container and then snap the suspending ring 4" on the closure 4*a*. Alternatively, the ring and closure may be first automatically assembled and the assembly may then be snap-fit to the container.

In the embodiment of FIG. 11, the suspending ring extends over the mouth of the container with friction fit. Depending upon the load within the container and the radial compressive forces between ring and container determined by relative sizing and selection of materials, the engagement may be sufficient to transfer the weight to enable finger suspension for transport or display. For an added degree of security, a heat shrunk security ring 21 as previously described, may be applied.

Figure 12:
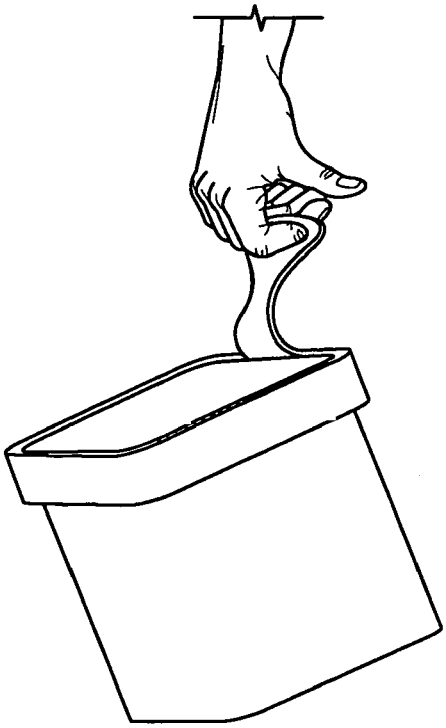
FIG. 12 shows a finger-suspended rectangular container.
Figure 12B:
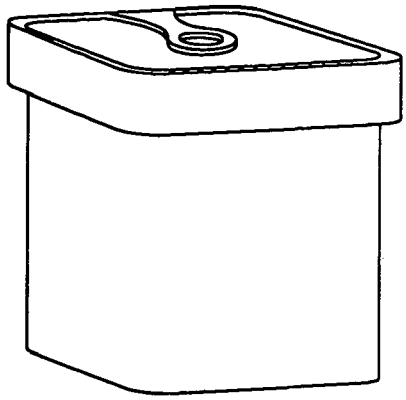
Figure 12A:
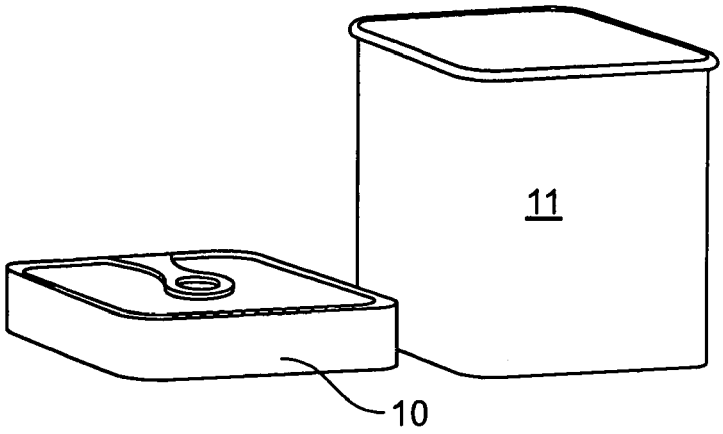
FIG. 12*a* is a dismantled view of the container.
Figure 12C:
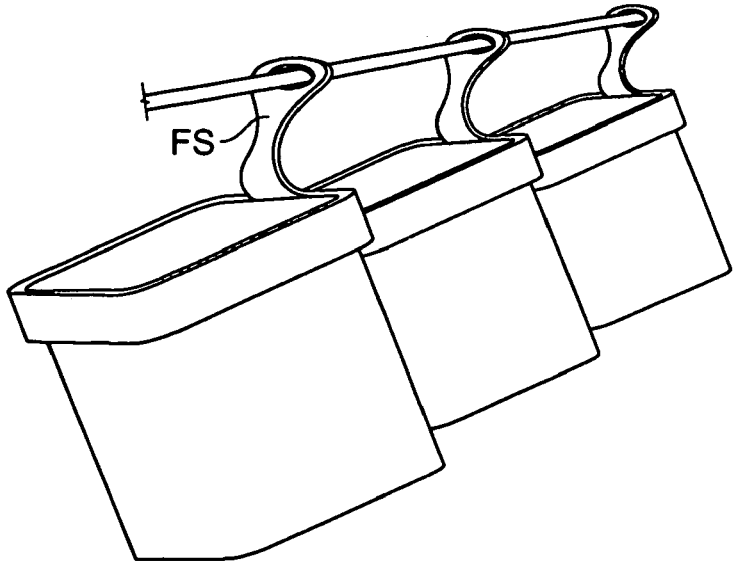
FIG. 12*c* shows a series of the containers hanging from their finger suspenders for display.

In the embodiment of FIGS. 12–12*c*, lid 10 and carton 11 are of square or rectangular profile, while having other features similar to those described. This particular embodiment provides for efficient use of hanging space. As illustrated in FIG. 12*c*, little open space remains between adjacent packages suspended on a rod.

Figure 13A:
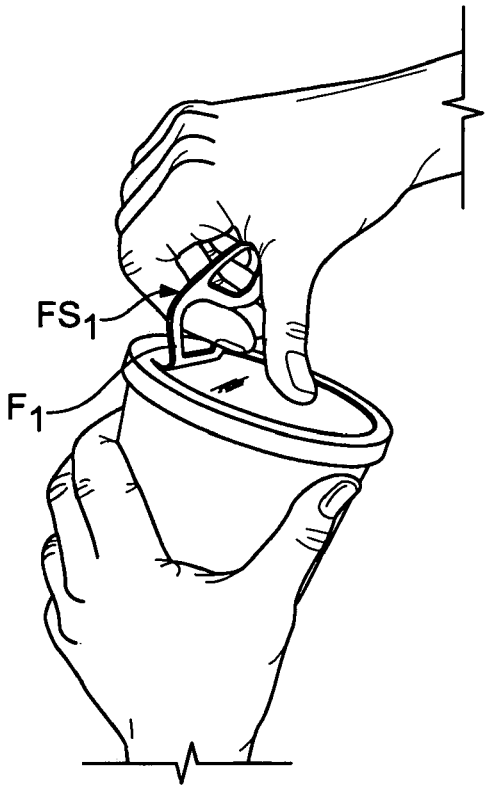
FIGS. 13*a* and 13*b* illustrate use of the shorter finger opening in a lid-bending action.
Figure 13B:
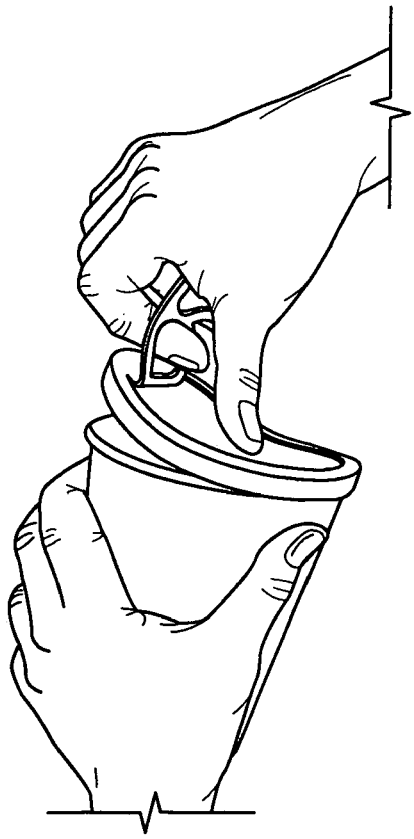
Figure 13:
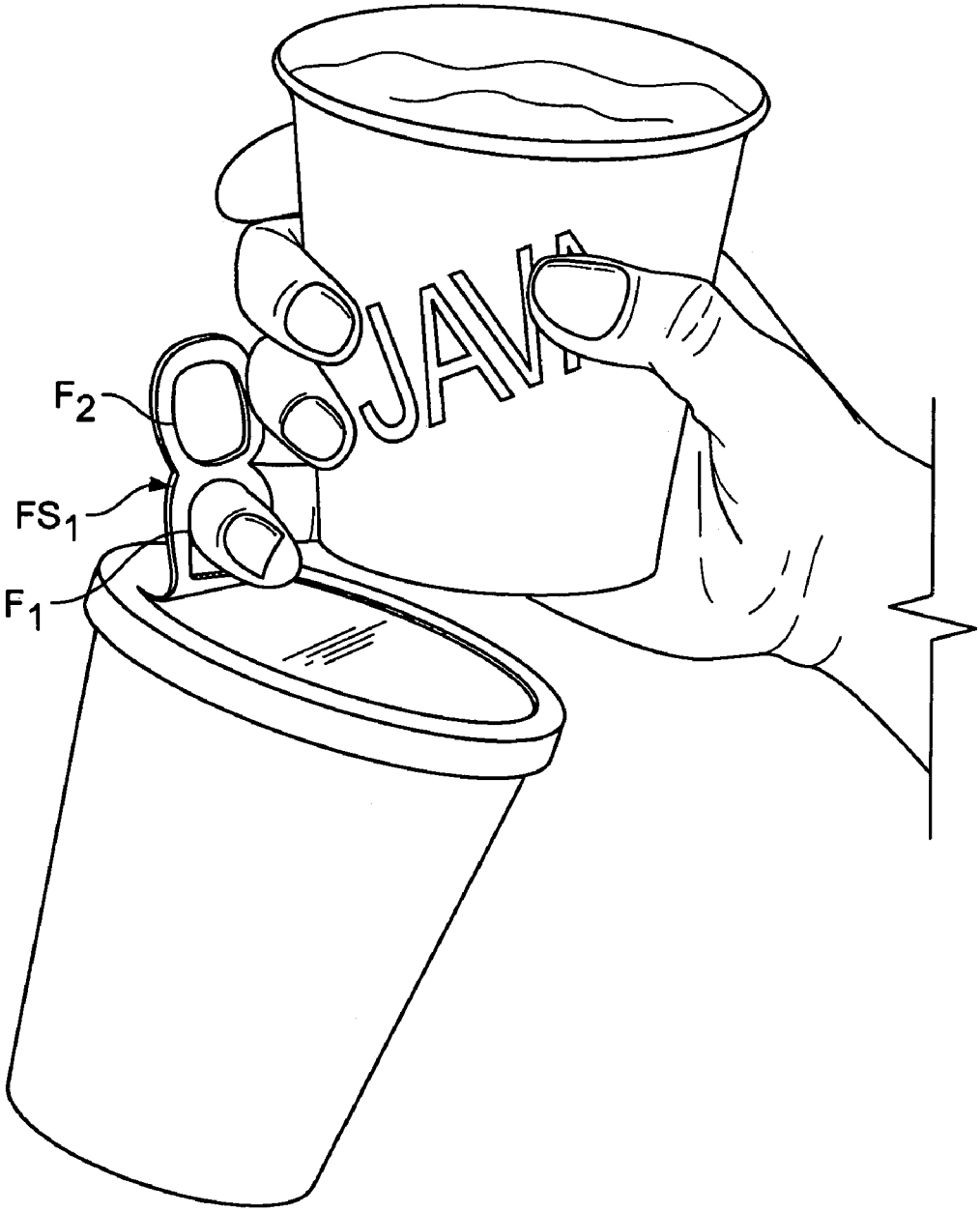

In FIG. 13 is shown a finger suspender $SF_1$ having two finger openings $F_1$ and $F_2$ spaced along the length of the suspender. The outer opening $F_2$ is employed as previously described.

The inner finger opening $F_1$ may be used, in accordance with user preference, to more snugly suspend a container relative to a hand, and in some cases to brace it against the lower edge of the hand. The lower opening $F_1$ is useful in certain instances to aid in lifting a lid as by interaction with the thumb. As shown, force applied by a finger inserted in opening $F_1$ is used to bend back the portion of the elastic lid to which the suspender is attached while the thumb holds down the center of the lid. In certain instances, only the lower finger suspending opening is employed as in FIG. 13 or FIGS. 13*a* and *b*, in which case the outer end of the suspender may be omitted.

FIG. 14 illustrates a preferred embodiment of a container having a lid 4' with a finger suspender FS formed integrally with lid top surface. The suspender FS extends from attached proximal end to a distal end. In its as-formed, relaxed state, it lies generally flat relative to planar top surface of the lid, thus allowing lid stacking and container stacking advantages. As with previous embodiments, lid 4' is provided with an internal film laminate attached along the undersurface of its rim to provide a seal between the container contents and the external environment. As before, the distal end of suspender SF has a hole for suspension of the container formed by the combination of the lid and cup as illustrated.

Figure 15:
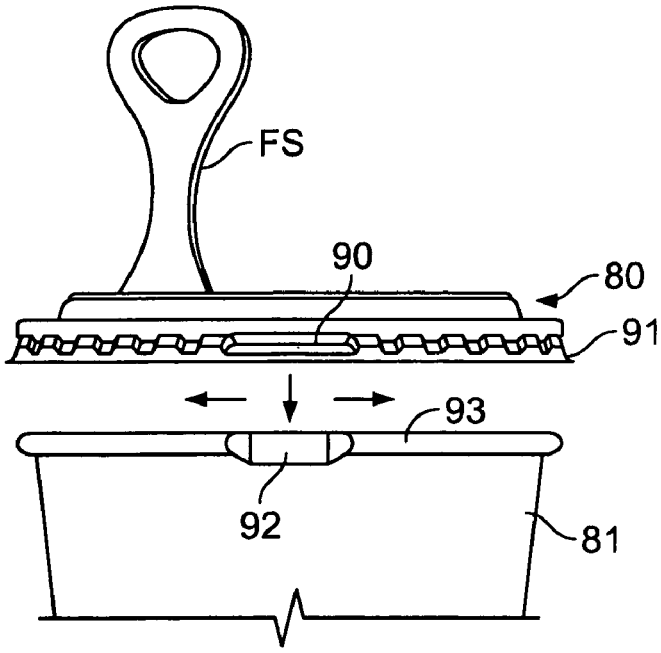
FIG. 15 is a broken away exploded view and FIG. 15*a* is a suspended view of a container having a twist lock lid.
Figure 15A:
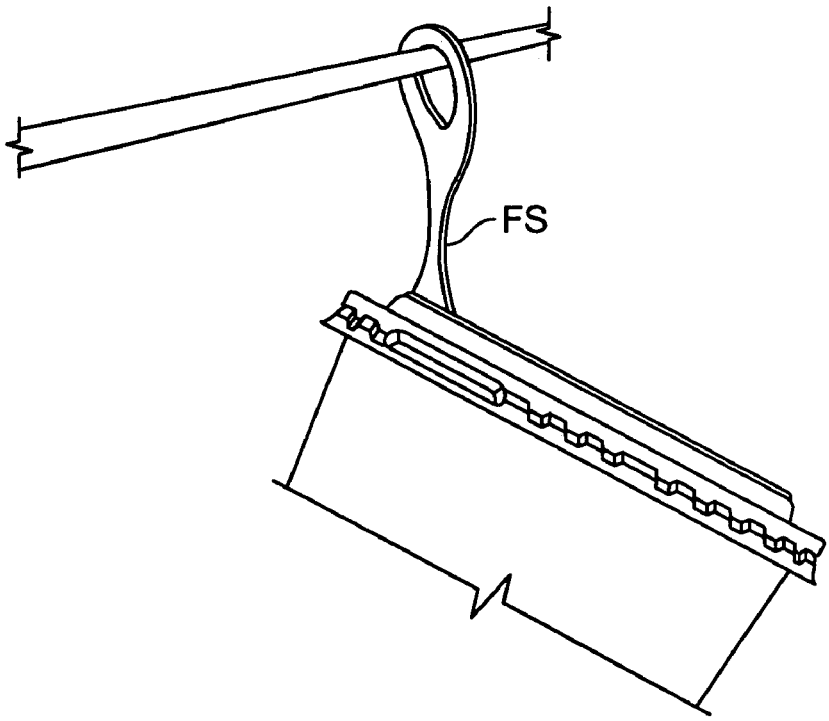

In an alternative embodiment, FIGS. 15 and 15*a* illustrate a locking arrangement for selectively securing a lid to a cup or other container. The locking arrangement is explained in U.S. Pat. No. 6,056,144, issued May 2, 2000, the entire contents of which are hereby incorporated by reference. Briefly, the lid 80 is equipped with locking formations 90 (only one shown) extending radially inward from lid flange 91. Cup 81 has recesses 92 (only one shown) formed along the bead 93 of its lid for allowing locking formation 90 to pass below bead 93 when lid 80, aligned with cup 81 as shown in FIG. 15, is pressed downwardly onto cup 81'.

Once locking formations 90 are below bead 93, lid 80 is rotated relative to cup 81 so that locking formations 90 are no longer aligned with recesses 92. Formations 90 then provide locking engagement with bead 93 to prevent removal of the lid from the cup. In this configuration, illustrated in FIG. 15*a*, the container, even with relatively heavy contents, can be suspended by finger suspender FS without disengaging the lid from the cup.

FIG. 16 illustrates a preferred embodiment of a container having a lid 70 with an integrally formed finger suspender $FS_2$. The suspender $FS_2$ extends from attached proximal end 74 to a distal end 76. A hole 78 is provided in distal end 76 to act as a loop for suspension of the container formed by the combination of lid 70 and cup 71 as illustrated.

In its as-formed, relaxed state, suspender $SF_2$ extends downwardly from lid 70 parallel to lid flange 73. This arrangement allows lid 70 to be stacked with like lids during lid manufacturing, storing, and any necessary shipping. Furthermore, containers having cups 71 and lids 70 filled with product, can be stacked for storage, shipping and handling without substantial interference from suspender $SF_2$ which lies, in its relaxed condition, parallel to the surface of the cup.

Figure 17:
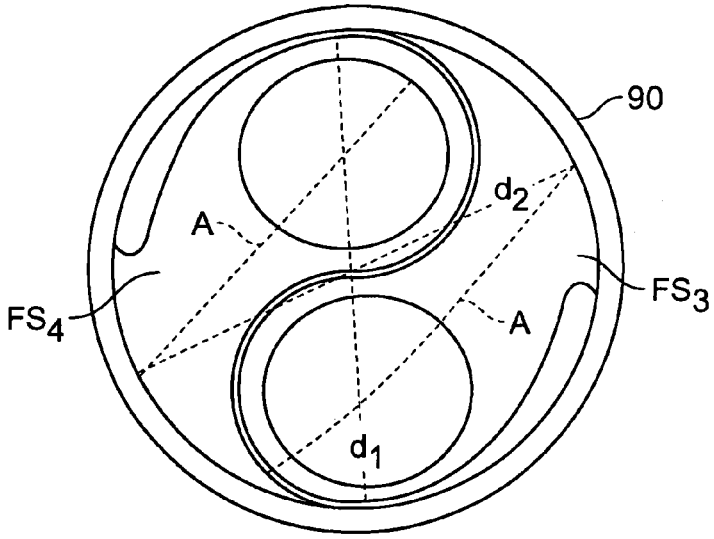
FIG. 17 is a plan view of a novel two-suspending element construction.
Figure 17A:
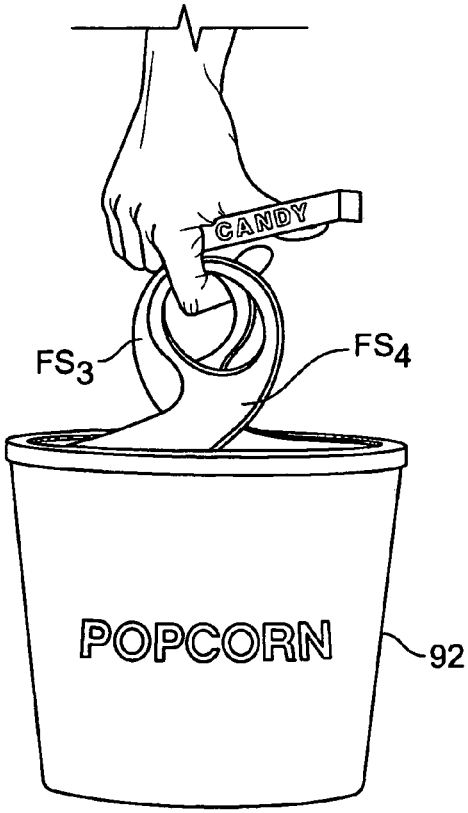

Referring to FIG. 17, for large objects a novel nested arrangement of a pair of finger suspenders $FS_3$, $FS_4$ is provided by an arrangement in which the center axis A of each elongated suspender is curved, and the centers of the two finger openings lie on a diameter $d_1$ of the circular top, with the hinge root region of each suspender being off-set from $d_1$ and of asymmetrical, spiral-like form. The roots of these suspenders are diametrically opposed along diameter $d_2$ which forms a substantial angle with diameter $d_1$.

Though upon applying load, the finger openings do not precisely align, still, by being suitably oversized, a common passage is defined by overlapped regions of the openings to admit one or more supporting fingers.

Lifting the two suspenders together causes the somewhat flexible rim of the snap ring to tend to pull into oval form, thus tightening symmetrical portions of the rim of the suspension ring against opposite sides of the container. This action effectively tightens the grip of the suspension ring on the container.

This ring and simple variations of it have the novel capability of conveniently handling large and heretofore unwieldy containers. The containers can be supported by a hand in a manner still enabling the hand to be free for other functions, as illustrated.

Applications of such a suspending rim, that snap fits over the conventional edge bead of a metal can or paper tub, range from carrying a heavy can of shortening or paint to conveniently handling of a tub of popcorn at the movies. Especially where maximum load-carrying capacity is not required, the root region of the suspenders may be narrowed and straightened, for increased flexibility.

Figure 18:
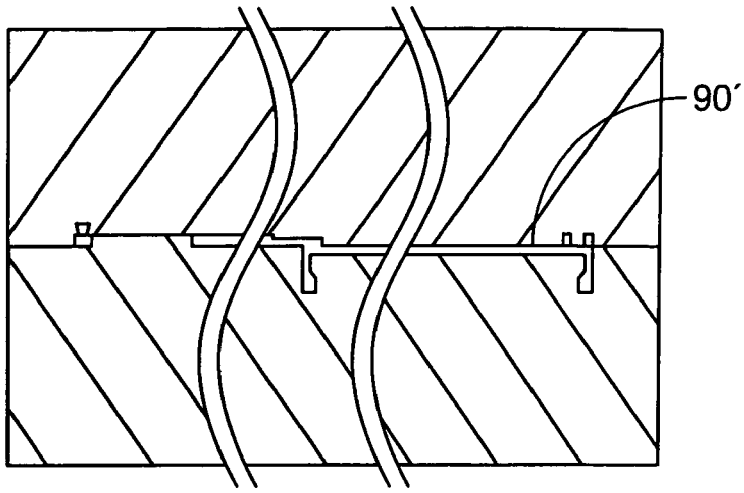
Figure 19A:
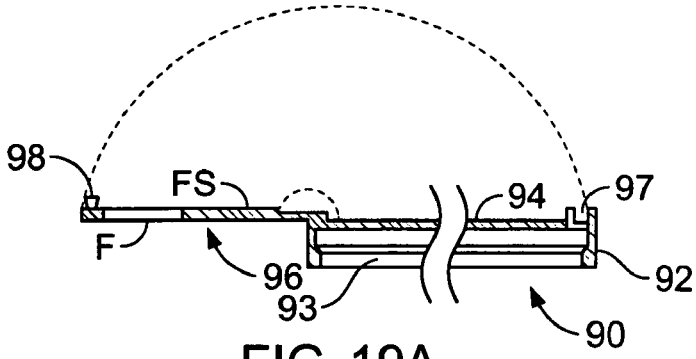
FIG. 19*a* is a side cross-section of the unit as it comes from the mold.
Figure 19B:
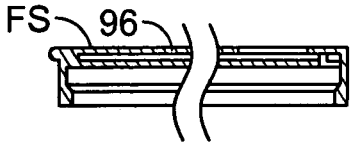
FIG. 19*b* shows the unit with the deflectable suspender at the plane of the ring and FIG. 19*c* shows the deflectable suspender in its use position.
Figure 19C:
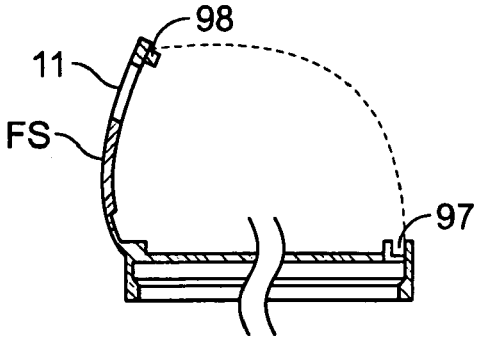
Figure 20:
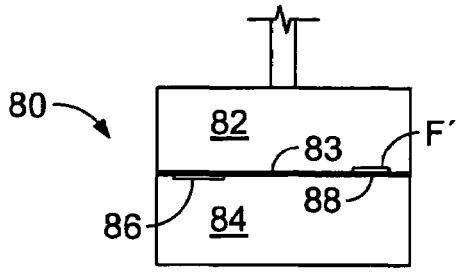
Figure 20A:
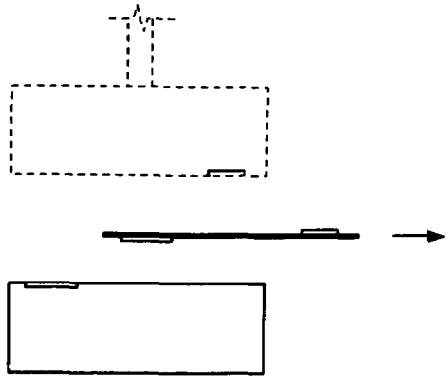
Figure 20B:
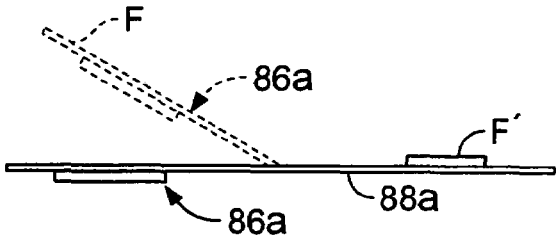
FIG. 20*b* is a diagrammatic side view of a suspender element and a sealing layer molded as a unit.
Figure 20C:
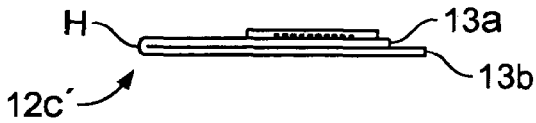
FIG. 20*c* illustrates the parts of the unit of FIG. 20*b* joined together.

FIGS. 18 and 19*a*–*c* relate to forming a fully formed overcap, and FIGS. 20 and 20*a* relate to forming an insert for insert injection molding of an overcap as a second step. In each embodiment, a forming sequence of molding and folding is illustrated. Referring first to FIG. 20, an injection mold 80 comprises upper and lower mold halves 82, 84 defining a "clamshell" mold cavity of two sections 86, 88 joined by hinge cavity section 83. Mold cavity 86 is of the form of a finger suspender having a finger opening F while mold cavity 88 is of the form of sealing layer of an overcap. After injecting the resin, the molded part is withdrawn, FIG. 20*a*. Suspender half 86*a* is rotated until its finger opening F matches with and snap-fits with a corresponding formation F' of the exposed surface of the lower layer 88*a*. The root R of the suspender element, preferably in the bifurcated form shown in FIG. 20*d*, may be thermo-welded to the underlying supporting layer 13*b*. Thus a completed mold insert 12*c*' is formed, with the presence of hinge H. The hinge may be cut away or incorporated in the molded rim of the attachment ring in the next operation, insert injection molding. Such molding will be discussed later in conjunction with FIGS. 21 and 22.

Figure 20D:
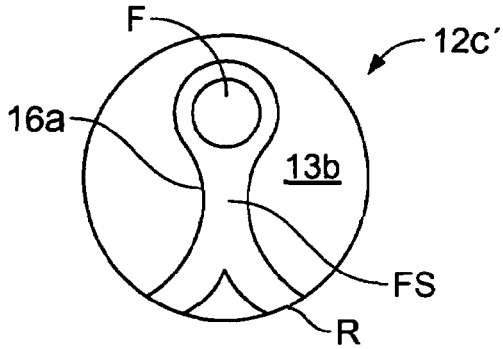
FIG. 20*d* is a top view of a suspender insert formed in the manner of FIGS. 20–20*c*.

FIG. 20*d* is a top view of a mold insert unit formed by the clamshell injection molding technique. In this case, finger suspender 16*a* independent of a surrounding rim is formed in the left cavity 84 of the clamshell mold and the bifurcated hinge, extending between the two clamshell mold halves, is of form suitable to be folded over and lie upon a sealing layer formed by the second mold half, to form the hinge for the suspender. In this configuration the hinge is to be surrounded by injection molded resin of the connecting ring when the ring is formed about the insert, hence is not cut away. Similar techniques can be employed to form a completed suspender unit, as will now be described.

Referring to FIG. 18, a completed overcap unit with finger suspender is formed by clamshell techniques in the same way as the product of FIGS. 20 and 20*d* except that the cavity 90' on the right side of the mold is shaped to form a complete snap lid 90, including both connecting ring 92 having formation 93 for engaging the rim of a container and a top sealing surface 94 for covering the container. The ring has a detent depression 97 facing upwardly, matched with detent 98 molded on the end of suspender 96.

After molding, the deflectable suspender 96 is folded over as suggested by the dotted lines of FIG. 19*a* to the position shown in FIG. 19*b*, in which detent 98 enters and is caught in depression 97. This retains the suspender 96 in its folded-down position.

When desired, e.g. after the overcap or lid has been snap-applied to a container, suspender 96 is pulled free of the detent. Due to memory of the plastic resin of which it is molded, it self-lifts to an upwardly angled position such as shown in FIG. 19*c*, ready to be grasped and suspended by finger opening 11.

Figure 21:
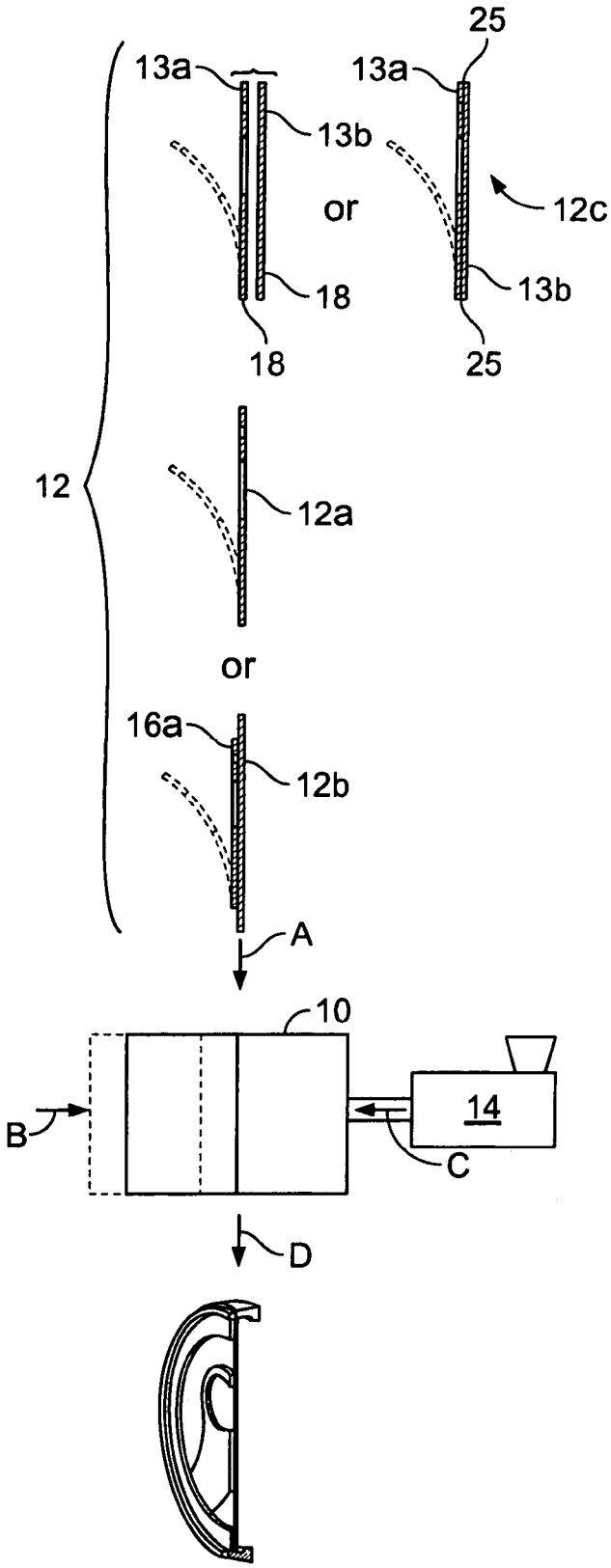
FIG. 21 is a diagrammatic side view of an injection molding station to which a suspender insert of various types illustrated can be introduced, and about which an attachment ring is molded by insert injection molding.

Referring to FIG. 21, an insert injection molding system for forming a snap ring of synthetic resin is shown. Mold 10 is operated between closed (solid line) and open dashed line) positions. During each mold cycle, a preformed suspender insert 12, shown diagrammatically in various selectable forms in FIG. 21, is automatically placed in the open mold, in a motion symbolically indicated by arrow A, using known insertion techniques. The mold is then closed, arrow B, suitable molten resin is injected into the mold by injection molding system 14, arrow C, the mold is opened to the dashed-line position and the molded article removed, arrow D. Removal can be caused conventionally, for instance by ejector pins (not shown), that enable the molded lid to be freed and fall from the mold by gravity, to be fed in conventional way to conventional overcap-stacking or handling equipment.

The preformed insert 12 preferably has one of a number of novel constructions depending upon the intended use for the suspender unit. It may have various peripheral forms depending upon the shape of the container with which the lid is desired to be used, for instance, round, oval, rectangular, square or triangular, each with or without rounded corners, etc. Some preferred inserts will now be described. For other examples, refer to PCT US03/14175, which has been incorporated in its entirety by reference.

Figure 22:
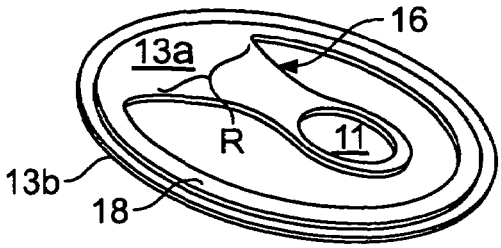
FIGS. 22–22*i* are perspective views of suspender inserts suitable for insert injection molding of attachment rings to form suspender units.
Figure 22D:
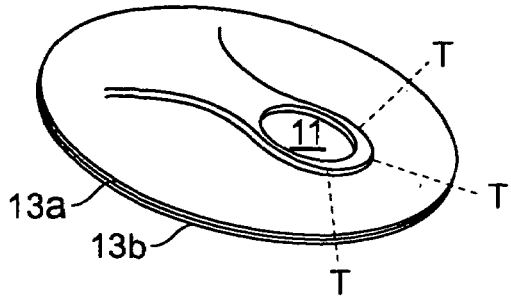
Figure 22A:
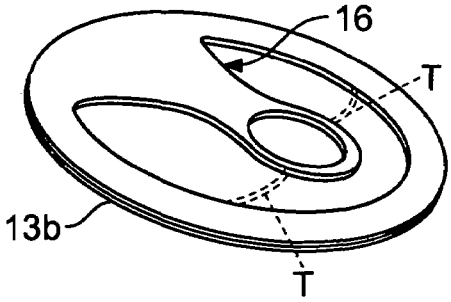
Figure 22E:
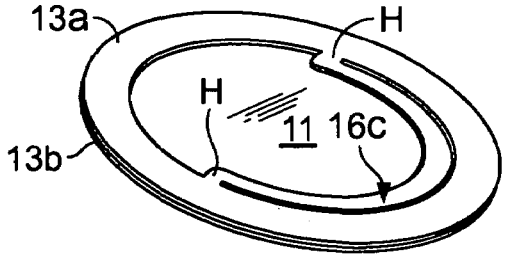
Figure 22B:
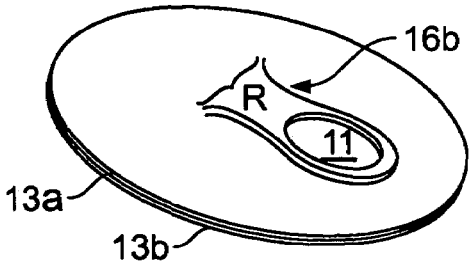
Figure 22F:
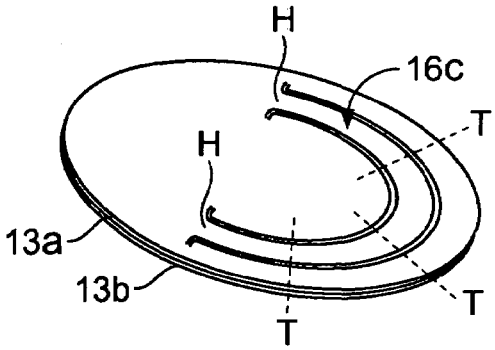
Figure 22C:
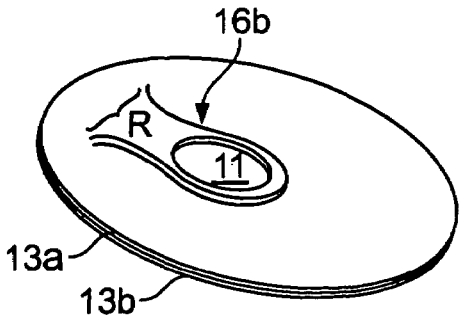
Figure 22G:
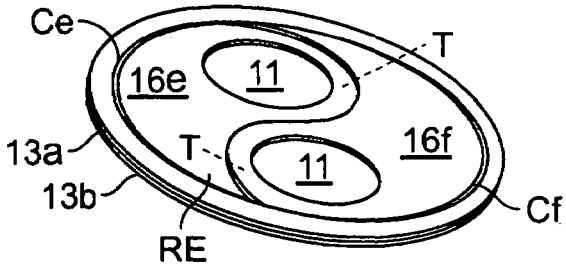
Figure 22H:
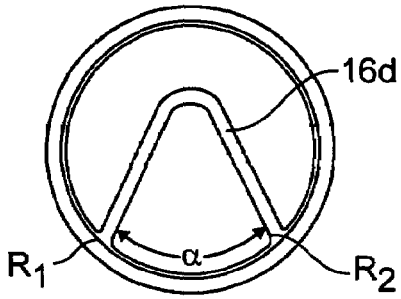
Figure 22I:
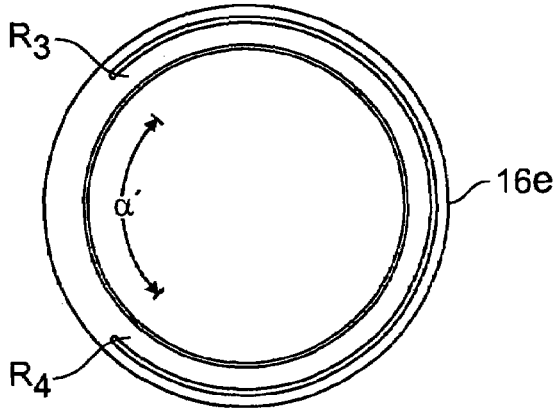

FIGS. 22–22*i* show preferred forms of suspender inserts, for use in insert injection molding of suspender units, or for serving as inserts to be integrated with pre-formed attachment rings as by snap-fit or adhesion. (Fully molded overcaps, i.e. with suspender monolithically molded with the central members of form similar to FIGS. 22–22*i*, may likewise be formed by techniques previously described, and are intended to be also illustrated by this sequence of figures.)

Figure 21A:
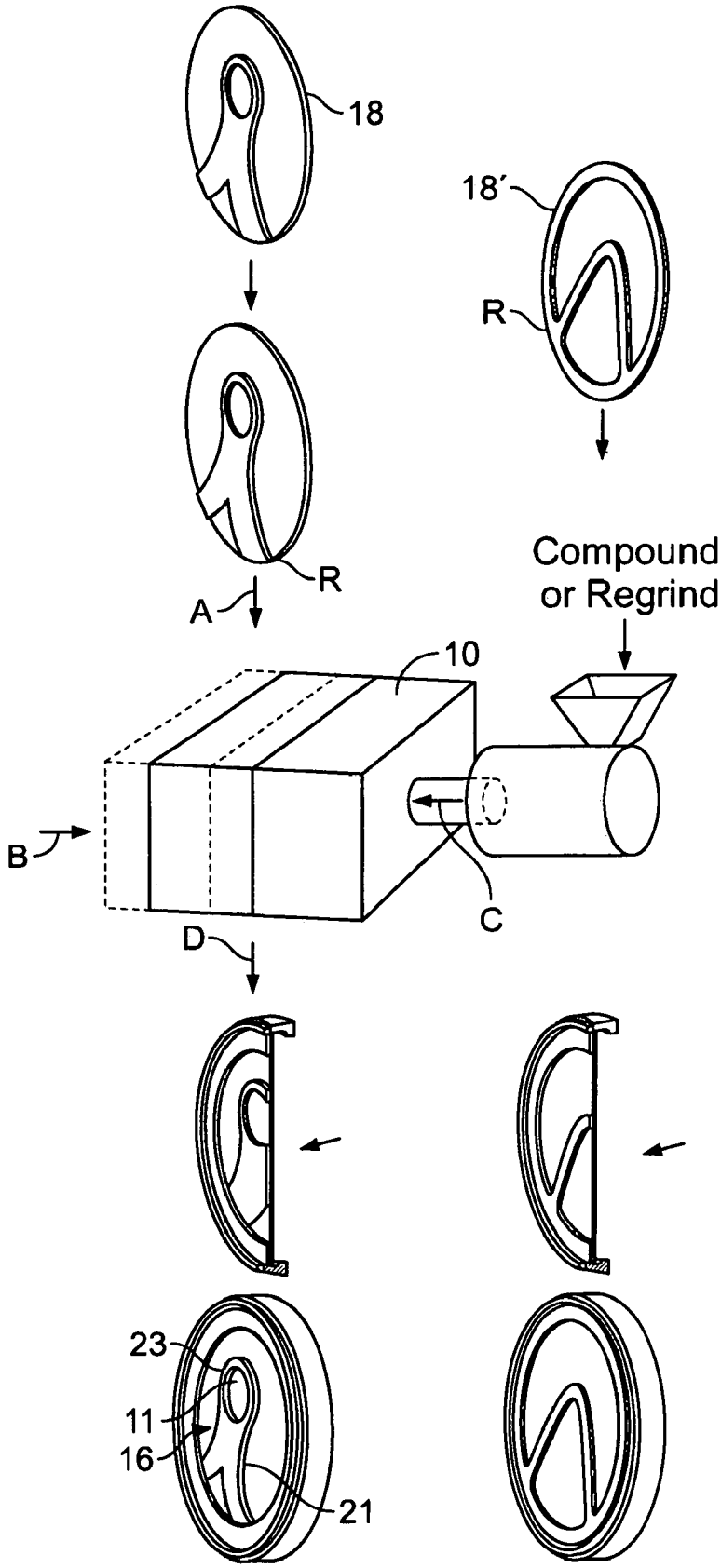
FIG. 21*a* is a view on an enlarged scale of a preferred embodiment of FIG. 21 in which the inserts being introduced to the mold are of two-layer construction comprising a top layer defining a deflectable suspender and below it a sealing layer.

The suspender unit of FIG. 21*a* formed with the insert assembly of FIG. 20*d* is an example of a completed unit formed by insert injection molding.

Each of the inserts of FIGS. 22–22*i* is comprised of two concentric layers, 13*a*, 13*b*, the bottom layer 13*b* providing a seal surface for the container and the top layer 13*a* providing a deflectable suspender. These layers, if constructed to be self-supporting, may each be independently inserted into an injection mold in succession as two separate pieces. In such cases, heat-activatable adhesive may be provided on one or both of the in-between surfaces which may be activated by the heat and pressure of the molding operation to bond them together if desired. In other advantageous instances, the elements are first formed and adhered together to form a single insert unit, as by the techniques described with respect to FIGS. 7–10 or as described in PCT US03/14175, which is incorporated by reference.

In the embodiment of FIG. 22, the lower seal layer 13*b* is of larger diameter than the layer 13*a* which forms the deflectable suspender 16. Layer 13*a* defines the root R of cantilevered finger suspender 16 and an annular supporting rim 18. The suspender 16 is much smaller in transverse lateral extent than the rim 18 and is surrounded by open space. Between the rim 18 and the suspender 16 and through finger aperture 11, the material of lower layer 13*b* is visible to the consumer, and if of transparent material, provides visible access to the goods within the container, as well as to any printing on layer 13*b*.

Alternatively, an insert such as 13*a* of FIG. 22, by being sized of diameter smaller than the ring of a preformed closure lid, may be attached at root R and at rim 18 to the top central surface of a pre-formed lid, rim 18 being of assistance in enabling automatic feeding, for instance if the element 13*a* is an injection molded part. Injection molding may be preferred for providing user-friendly features such as smooth and enlarged finger-engaging surfaces at opening 11, or features corresponding to a desired aesthetic product design.

The embodiment of FIG. 22*a* differs from that of FIG. 22 in that the two layers are of the same diameter. The provision of optional retaining runners, strands, tabs, tack welds or adhesive spots for temporarily retaining the suspender at its original plane is suggested by dashed lines T. Such provisions may be employed in all of the embodiments of FIGS. 22–22*i*.

The shortened suspenders of the mold inserts of FIGS. 22*b* and 22*c* lying in the plane at the upper layer 13*a* are formed with finger holes 11, to serve as finger suspenders integrated with the overcap. In some instances the holes here, as well as in the other embodiments of overcaps, lids and rings may be made smaller and serve only as receivers for hanging rods or hooks for display purposes, or larger to provide greater visual access through transparent sealing layers and the like. In the embodiment of FIG. 22*b*, root R is located centrally of the lid, to enable the container to be suspended in straight-up orientation (not tilted), as may be desirable for certain sales displays, or for finger suspension of goods or fluids that may tend to leak from a resealed container. In the embodiment of FIG. 22*c*, the root region R of shortened suspender 16*b* is located close to the periphery, to cause the container to be suspended at an angle for desirable display effects, or for convenience when the hand is also holding other objects. The inserts of FIGS. 22 and 22*c*, as with all of the inserts of FIGS. 22–22*i*, are of circular peripheral form, that can enable automatic feeding if the parts are injection molded, for instance.

The insert of FIG. 22*d* provides the finger suspender essentially as a cut-out, e.g. from paper stock as described in FIGS. 2 and 5 of PCT US03/14175.

The inserts of FIGS. 22*e* and 22*f* define bail-like suspenders 16*c* attached at diametrically opposite flexible hinge regions H. The embodiment of FIG. 22*e* with a large central cut-out gives wide visual access through layer 13*b* when transparent. In certain embodiments it is advantageous that hinge regions H, indeed the entire layer 13*a*, be of polypropylene or other material or construction of suitable strength and flexibility to form a living hinge of sufficient strength out of regard for the particular weight planned for the associated container and its contents. Flow conditions in the mold can be engineered in accordance with living hinge principles to achieve orientation of the polymer in the hinge region, where the characteristics of such orientation is desired.

Figure 17B:
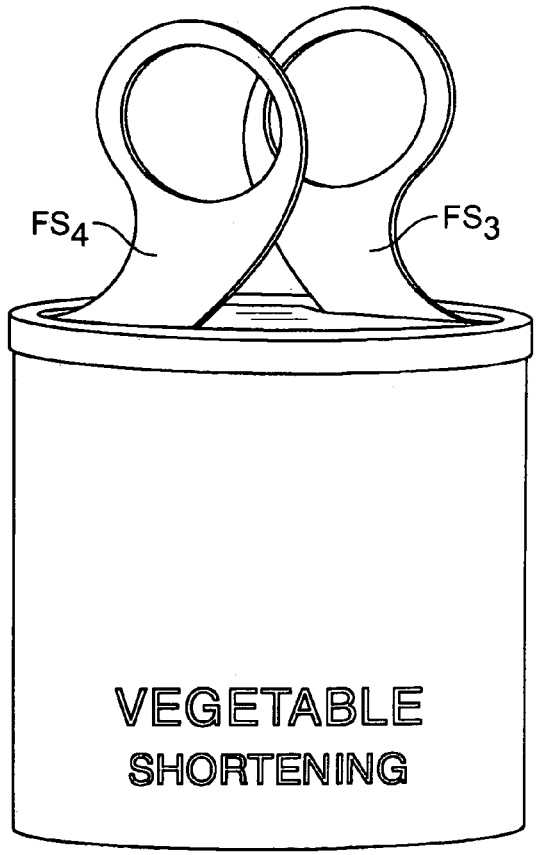
FIG. 17*b* illustrates use of the construction for transport of a heavy can.

The insert of FIG. 22*g* defined as a pair of finger suspenders 16*e*, 16*f*, is formed according to principles discussed above in relation to FIGS. 17–17*b*. Clearance slots Ce and Cf enable the respective suspenders to flex about their respective roots Re, Rf.

It is to be noted that the embodiments of FIGS. 22*f* and 22*g* employ thin clearance slots between the suspenders and adjacent material, making these designs, as well as those of FIG. 22*d*, suitable for including temporary retaining runners tabs or filaments T, e.g. as discussed above, for retaining the suspenders in the plane of their layers until desired to be lifted, and also, in molded embodiments, providing advantageous mold cavity-filling runners.

The insert of FIG. 22*h* is of bail-like form with separate roots $R_1$, $R_2$ at the two ends of the thin bail member 16*d*. Roots $R_1$ and $R_2$, however are spaced apart arcuately, at angle $\alpha$ substantially less than 180°. Indeed in the preferred embodiment shown, angle $\alpha$ is less than 90°, in the range of 50 to 70°. Such offset location of the roots $R_1$, $R_2$ ensures that the container, supported by the bail, will hang at a desired acute angle to achieve the advantages of tilt that have been described. The bail provides an opening suitable for a finger, or indeed for the entire band of a child, depending upon scale.

Similar advantages are obtained with the insert of FIG. 22*i*. In this case angle $\alpha'$ between roots $R_3$ and $R_4$ is of the order of 90°, still an angle to ensure significant tilting of the suspended container. In this case roots $R_3$ and $R_4$, and the bail 16*e* lie at the outer periphery of a closed disk. The mold into which the insert is placed is constructed to form the joining ring concentrically, inwardly of the bail 16*e*, so that the bail lies outwardly of the rim of the resultant resilient overcap formed by the techniques of FIGS. 21 and 21*a*.

In other advantageous instances, depending upon types of packaging materials selected, all of the forms shown in FIGS. 22–22*i* may be manufactured of preformed sheet material, e.g. of plastic, chip board or coated paper stock, or may be comprised of injection molded or insert injection molded parts, e.g. using techniques described above.

Figure 23:
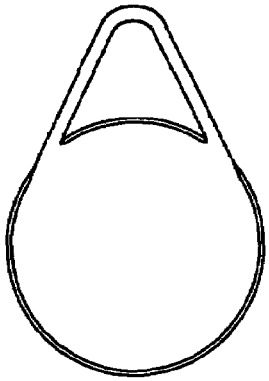
FIGS. 23 and 23*a* illustrate two stages in the forming of an off-center bail suspender using clamshell type molding techniques.
Figure 23A:
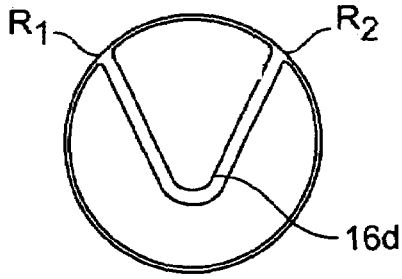

In FIGS. 23 and 23*a* is illustrated the forming of an off-centered insert employing clamshell molding techniques as generally described in relation to FIGS. 18 and 20. The unit is first molded as shown in FIG. 23, then folded to the form of FIG. 23*a*.

The inserts have been shown round for convenience of illustration, and because many times round mouthed containers are preferred for use with the invention such as for round disposable snack food, cookie or chip containers, coffee cups or tennis ball cans. For instance in FIG. 21*a* each of the inserts has a circular peripheral rim portion and carries in its mid region a flexible suspender extending from roots near the periphery. In certain cases it is preferred that the deflectable suspender be in the form of an elongated finger suspender 16 of cantilever form having elongated leg 21 and enlarged distal head 23 defining an opening 11 sized to receive a finger. The deflectable portion extends at least half the dimension of the insert in length, in many advantageous cases being about 2 inches or more in length.

Figure 24:
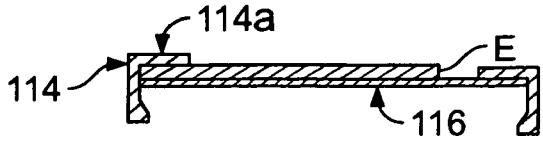
FIG. 24 is a cross section of a plastic molded annular ring of a lid, having an inwardly extending flange, and a circular chipboard insert having its outer margin adhered to the underside of the flange of the ring, the insert having a folded, free-ended finger suspender of chipboard lying within the bounding planes of the lid.
Figure 24A:
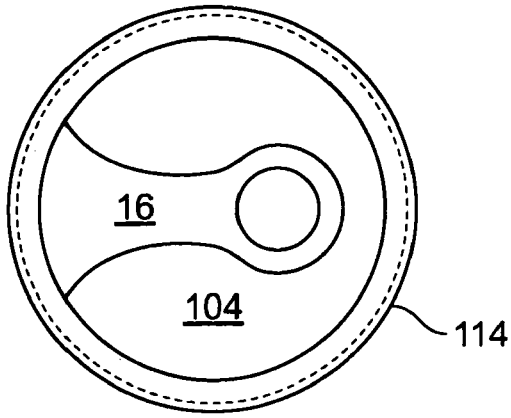
FIG. 24*a* is a top view of the lid of FIG. 24.
Figure 24B:
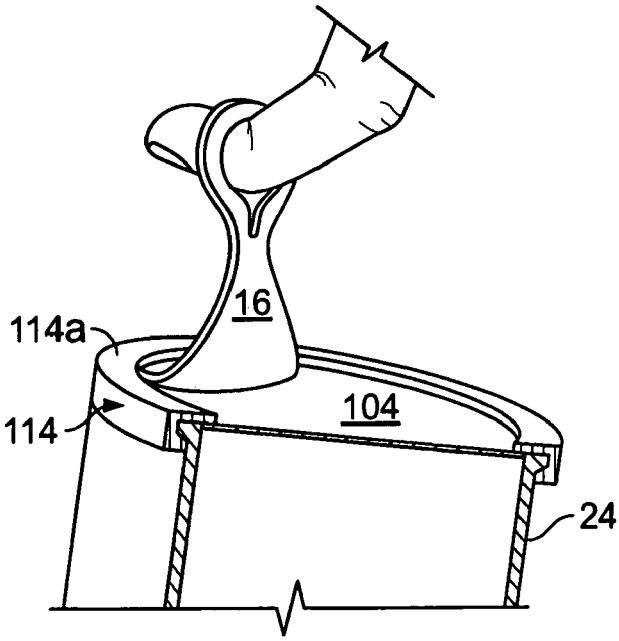
Figure 24C:
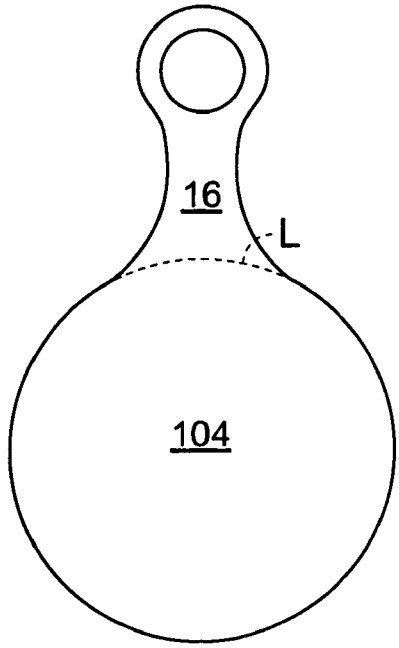
FIG. 24*c* shows the chipboard cut-out insert prior to the finger suspender being folded to the position shown in FIG. 24.

In the embodiment of FIGS. 24–24*c*, a chipboard insert 104 is inserted into a preformed plastic ring to complete the lid. As shown in FIG. 24*c*, the insert in this case comprises a complete circular disc of the paperboard to form a sealing layer, and an outer extension defining a finger suspender 16, that originates in the plane of the disc. This suspender is folded inwardly about the fold line L indicated, and, thus folded; the insert is attached to the underside of the inwardly protruding flange 114*a* of the plastic ring, with adhesive not shown. As can be seen in the cross section of FIG. 24, the finger suspender extends from one side of the ring to a free end E near the other side. As shown in FIG. 24*b*, after the lid is snap fit to the container 24, this finger suspender 16 can then be deflected by a finger, as the finger suspends the container 24, as shown.

Figure 25:
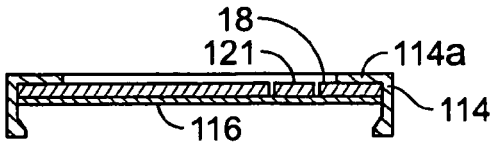
FIG. 25 shows a molded plastic snap ring of annular form, with inwardly extending flange, to the underside of which a die cut disc is adhesively applied, the disc including a circular chip board piece having a die-cut semi-circular fold-up handle, and, on the underside of the whole chip board cut out, a sealing film laminated about its circular margin to the chipboard (not to the handle)
Figure 25A:
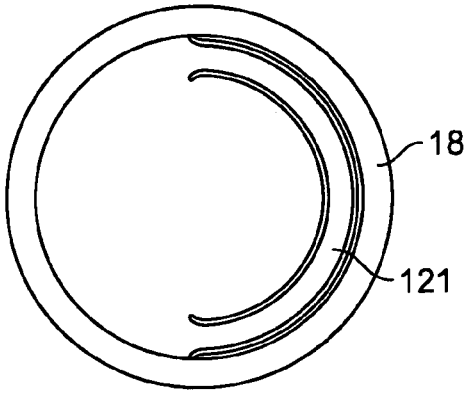
FIG. 25*a* is a top view of the lid of FIG. 25
Figure 25B:
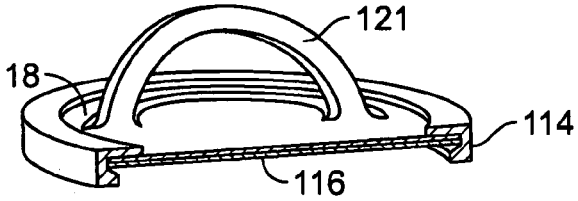
FIG. 25*b* is a perspective view of the lid of FIG. 25, with the handle folded into position for use, while the seal remains in tact.

In the embodiment of FIGS. 25–25*b*, chipboard is die cut to form a flexible handle 121 of half circular shape concentric with its outer rim. This insert again is inserted and adhered to the under surface of the inwardly extending flange 114*a* of the pre-molded snap ring 114. Sealing film is adhered to the underside of the chipboard, without bond to the handle, to create a seal. As shown in the perspective view of FIG. 25*b*, the handle 121 can be deflected to suspend the lid and the container, not shown, to which the lid is removably attached.

Figure 26:
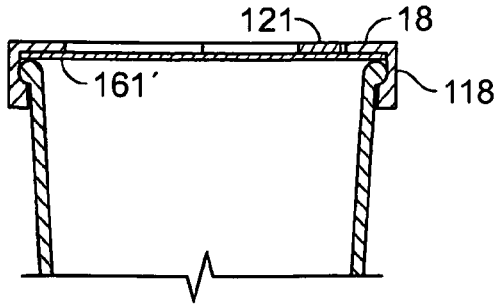
Figure 26A:
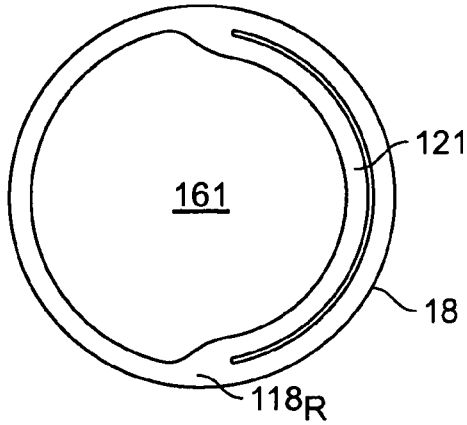
FIG. 26*a* is a top view of the lid of FIG. 26.
Figure 26B:
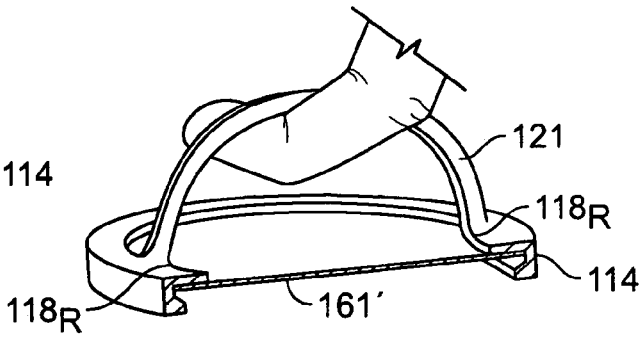
FIG. 26*b* is a perspective view showing the handle flexed to suspending position. To the underside of an inwardly extending flange of the ring is adhered a sealing insert which may be a sealing film, a sealing chipboard printed insert or a combination thereof.

The embodiment of FIGS. 26–26*b* is of similar construction, except that the large space 161 circumscribed by the inner edge of the bail-like handle 121 and the opposing portion of the rim 18 of the insert, is left open, providing, a viewing area of large dimension, by which the sealing film 161' can be seen, and with the film transparent, the goods in the container can be seen. The handle 121 is deflectable about root region 118R by a finger to the suspending position of FIG. 26*b*, but, in the vernacular of this description, this is a bail handle, not a finger suspender.

Figure 27:
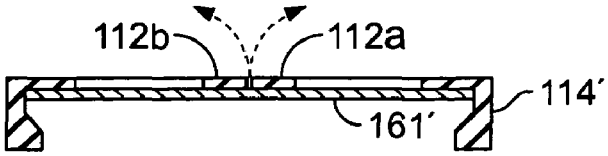
FIG. 27 is a view, similar to FIG. 26, of another molded rim and handle arrangement, in this case two arcuate handles extending inwardly to the center from root joining sections 20 that are offset from an axis of symmetry adjacent the most inward protrusion of the two handles.
Figure 27A:
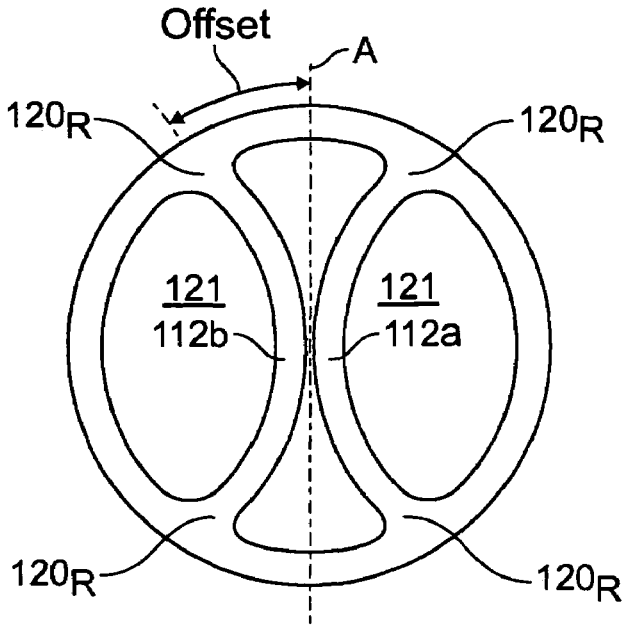
FIG. 27*a* is top view of the lid of FIG. 27
Figure 27B:
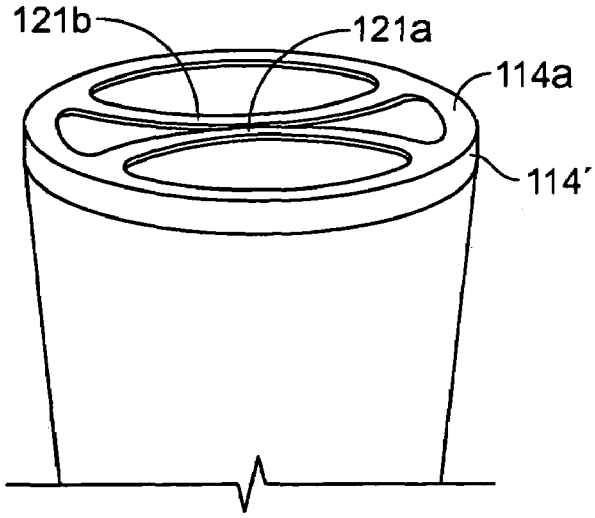
FIG. 27*b* is a perspective showing the handles in their distended position. A sealing insert similar to that of FIG. 27 is shown in place.

The embodiment of FIGS. 27–27*b* has two arcuate handles 121*a*, 121*b*, molded of plastic integrally with the snap ring 114', that meet at the center of the lid Axis A, the roots of attachment 120R of these arcuate plastic handles being off-set about 20 degrees to each side from the center diametrical axis A. As indicated by the arrows in FIG. 27, and the perspective view of FIG. 27*b*, these handles can be deflected to slightly raised and twisted upright positions to support the container. A sealing layer 161' inserted and adhered to the underside of the inwardly extending flange 114*a* of the attachment ring provides the sealing layer, and if transparent, provides visual access through the large openings circumscribed by the handles and the rim of the snap ring, as shown.

Figure 28:
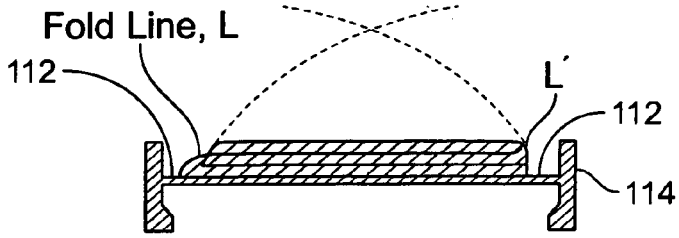
FIG. 28 is a vertical cross section of a molded snap ring lid having a continuous molded closing surface extending across the top. To the upper surface of the top is adhered a chipboard die cut piece having two free-ended finger suspenders in inward, flat folded condition, lying within the upper and lower bounding planes of the lid.
Figure 28A:
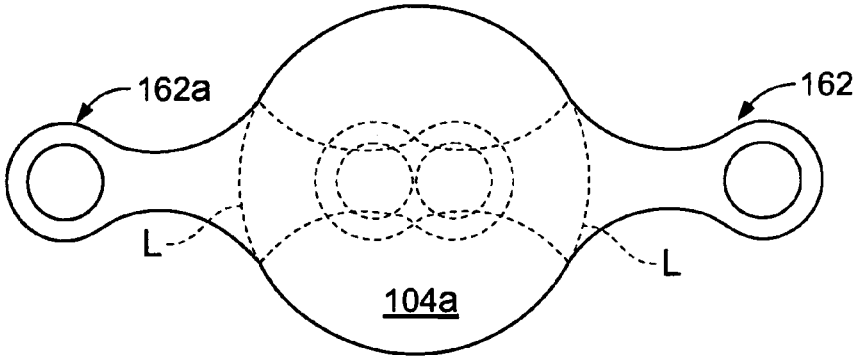
FIG. 28*a* shows in plan view the chipboard piece before the suspenders have been folded to the position shown in FIG. 28. When desired, these suspenders are folded upwardly along the dotted paths suggested in FIG. 28.

The embodiment of FIGS. 28 and 28*a*, is similar to the embodiment of FIG. 24 in having a solid central disc 104*a* of adhesive-backed chipboard, but in this case two diametrically opposed finger suspender extensions 162 and 162*a* protrude to opposite sides of the disc 104*a*, and are folded over in overlapping condition, about the indicated fold lines L, to the position shown in the cross section of FIG. 28, within the confines of the molded ring 114. The disc 104*a* in the embodiment shown is integrated face to face to the upper surface of a molded closure lid portion 112 extending across the snap ring 114. When unfolded in the directions of the arrows, this embodiment provides two suspenders, at opposite sides of the lid, each having an extent longer than half the diameter of the lid, each having a root region L near the ring, an elongated leg and an enlarged distal head that defines a finger opening.

Figure 29:
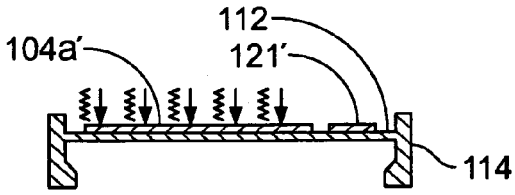
FIG. 29 is a vertical cross-section and FIG. 29*a* is a plan view of a molded plastic lid as shown in FIG. 28, to the top surface of which is adhered a circular chipboard member defining a handle, joined at diametrically opposite hinge regions. All but the underside of the handle has the adhesive, as suggested in FIG. 29*b*.
Figure 29A:
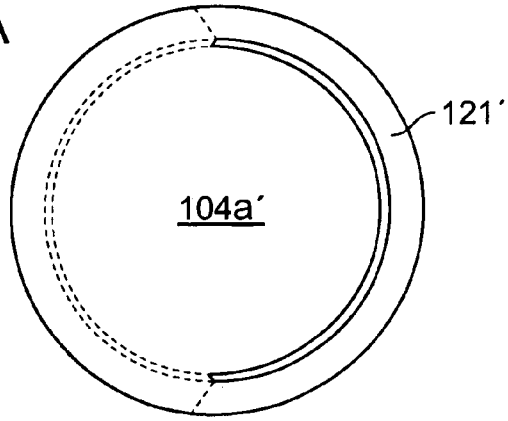
Figure 29B:
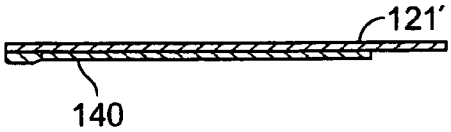
In FIG. 29*c* a perspective shows the handle in extended position.
Figure 29C:
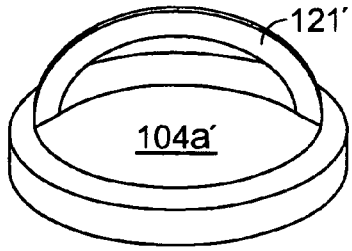

The embodiment of FIGS. 29–29*c*, has a handle 121' similar to that of FIG. 25, formed by a suitably die-cut disc of chipboard that is integrated face to face with adhesive, heat and pressure as shown, to the top surface 112 of a preformed lid, the adhesive 140 being omitted in the region of the lift-up handle 121', so that the handle can move to the upright, suspending position shown in FIG. 29*c*.

Figure 30:
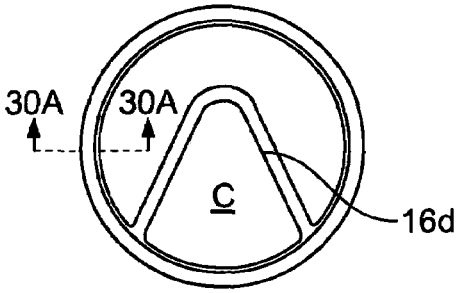
FIGS. 30–30*a* show a monolithic overcap having an integral, inwardly extending off-center bail, extending parallel to the sealing surface, in form similar to that of FIG. 22*h*, FIG. 30 being a plan view, FIG. 30*a* a cross-sectional view of the rim taken at line 30*a*—30*a* of FIG. 30, FIG. 30*b* a perspective view showing folding upright of the asymmetric bail and FIG. 30*c* a perspective view showing paired, tilted hanging of two containers supported by off-center bails.
Figure 30A:
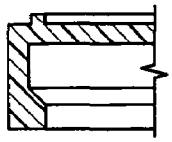
Figure 30B:
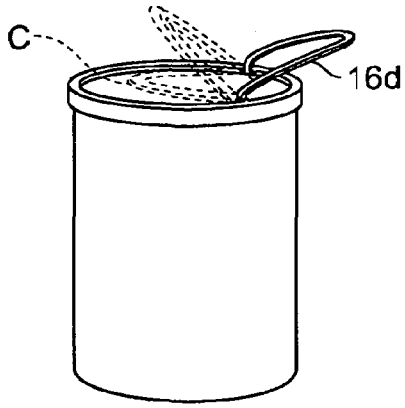
Figure 30C:
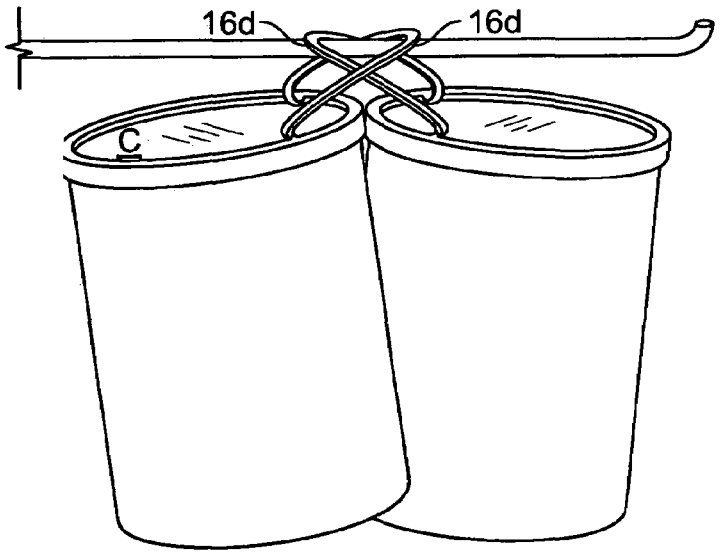

For description of the asymmetrically mounted bail of the overcap of FIGS. 30–30*c*, refer to the description of FIG. 22*h*. In the instance of the overcap of FIG. 30, it is molded as one piece. A retractable core as described in connection with FIG. 7*a* may be used for instance to enable forming a continuous top C, and above it the mold bail 16*d*.

Figure 31:
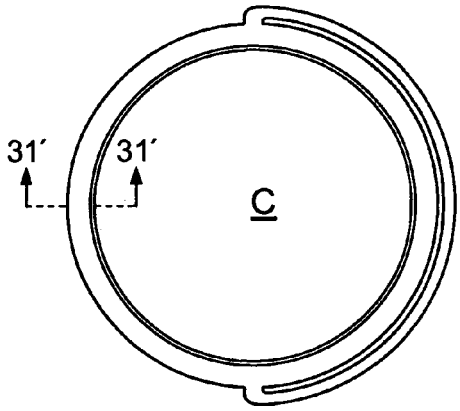
Figure 31A:
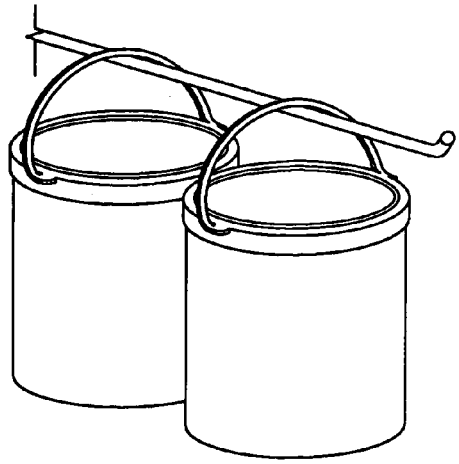
Figure 31:
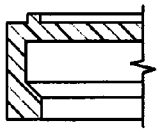
Figure 31B:
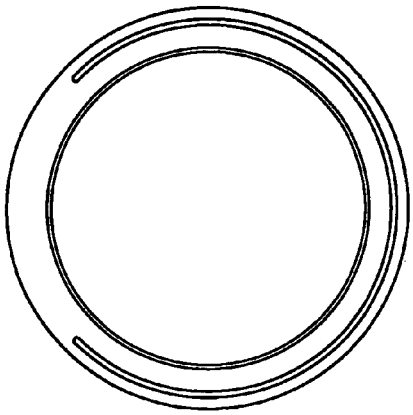
FIGS. 31*b* and 31*c* are top and perspective views of an outside, asymmetrically molded bail.
Figure 31C:
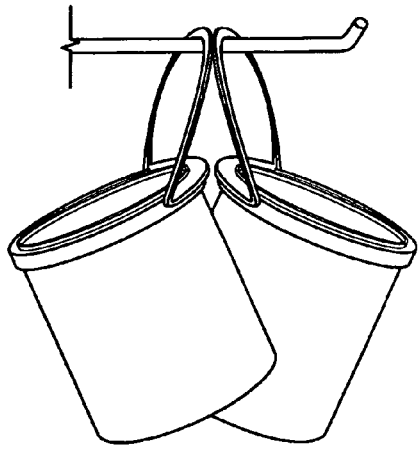

A monolithic molded overcap of resilient resin having a asymmetrically located bail is shown in FIGS. 31, 31' and 31*a*. The top C of the overcap is closed. As shown in FIG. 31*a*, a container tends to hang straight occupying a vertical volume corresponding to the container. In contrast, the asymmetrically mounted bail of FIGS. 31*b* and 31*c* ensures tilt of the container. The bails of two containers may closely approach one another, and can result in better utilization of a hanging peg and more interesting presentation of the product.

Figure 32:
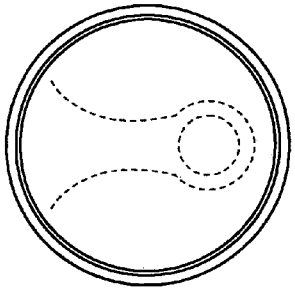

The series of FIG. 32 illustrates constructions in which the outline of finger suspender overcaps are defined, but the outer surface of the top of the overcap is un-interrupted. Such a design may be desirable where graphic print is to be placed on the top of the overcap without interruption by presence of the suspender, or in cases of handling the product by suction lifters that are particularly sensitive to air leakage that might occur at minor surface discontinuities provided by the finger suspender.

Figure 32A:
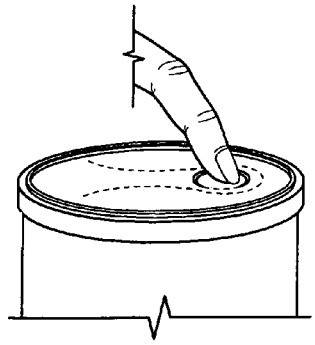
Figure 32B:
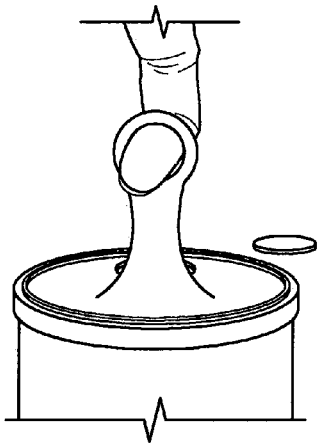
Figure 32C:
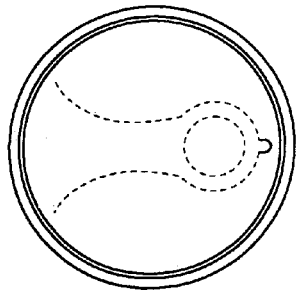
FIG. 32*c* is a plan view and FIGS. 32*d* and 32*e* are views similar to FIGS. 32*a* and 32*b*, respectively, of use of the overcap of FIG. 32*a*.
Figure 32D:
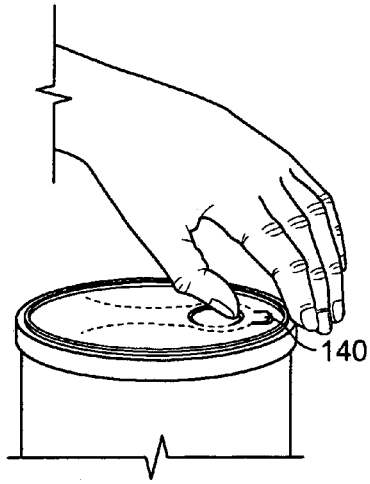
Figure 32E:
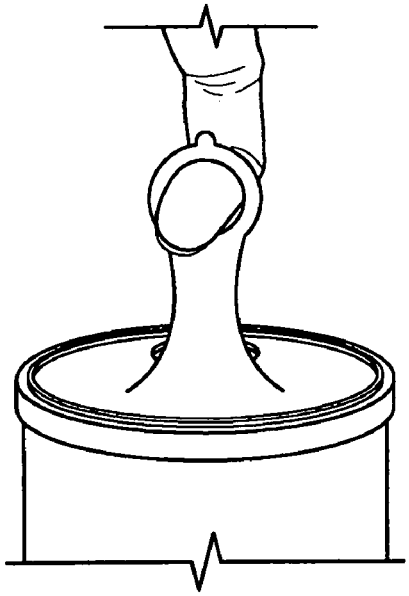
Figure 32F:
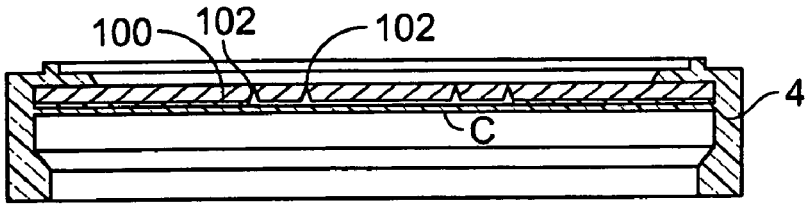
FIGS. 32*f* and 32*g* are cross-sectional views of alternative ways of forming the overcaps of FIGS. 32 and 32*a*.
Figure 32G:
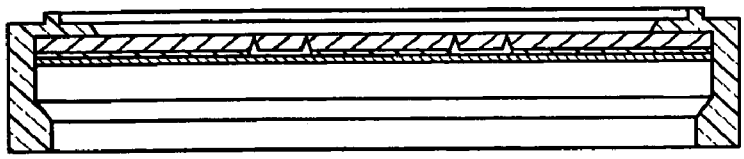

The two examples shown in FIGS. 32*f* and 32*g* are produced by insert molding techniques, see the discussion related to FIGS. 21 and 21*a*.

For the embodiment of FIG. 32*f*, a chip board insert 100 has score lines 102 in its undersurface that define the outline and break-away capability of a finger suspender as has been described.

The undersurface of the suspender itself, as well as the material filling its finger hole, is covered with release varnish selected to prevent binding with contacting molten resin. The remainder of the undersurface is left plain, and capable of tenaciously bonding to injected molten resin. The areas of strong bond are indicated by the darkened line at the interface of the respective regions in the diagram. Upon injection of the molten resin, the attachment ring 4, sealing cover C and other typical features of a resilient overcap are molded of thermoplastic resin, about the insert, in the manner of insert injection molding previously described.

In use, as shown in FIG. 32*a*, pressing on the outline of the finger hole of the finger suspender is effective to deflect the top of the overcap such that the inner edge of the suspender hole breaks and can be gripped and raised. This action separates the suspender from the bounding portions of the insert that remain tightly bonded to the plastic cover C. The center filler of the finger hole can readily be dislodged, as noted in FIG. 32*b*.

In the case of the construction of FIG. 32*g*, a pull-up tab 140 is provided at the distal end of the finger suspender. It can be a permanently raised protuberance, or a protuberance that rises in response to depression of the suspender form, as by provision of a suitable rocker structure, not shown. In the case of use of such pull-up tabs, it is appropriate for the material surrounding the outline of the finger suspender and as well, the filler of the finger hole, to be bonded to the underlying layer, while the suspender and tab remain free of such bond. Raising the tab breaks free the finger suspender, ready for use, and separates it from the filler that is retained by its strong bond.

Numerous modifications and other embodiments will be apparent to those skilled in the art and are comprehended by the following claims.

What is claimed is:

1. A support constructed to be connected with a predetermined container of the type having an upper formation extending about a top portion that is open or constructed to be opened, the support comprising:

a surrounding structure-constructed to surround and interfit with the upper formation of the container to suspend the container with its contents, the surrounding structure being shallow, having an axial dimension substantially less than its lateral dimensions and at least one flexible suspending element that is integrated with the surrounding structure and constructed and arranged to suspend the surrounding structure and, thereby, the container, the suspending element having an as-formed position in which the suspending element lies generally within the surrounding structure, extending from at least one root that either directly or indirectly is in supporting relation with the surrounding structure, to a free portion, the free portion of the suspending element arranged to be lifted from the as-formed position to a raised operating position for engagement by a carrier, thereby to suspend the container by its upper formation in a position below the carrier for display or transport, the at least one suspending element and the surrounding structure being so cooperatively related that lifting the free portion of the at least one suspending element relative to the surrounding structure to raised operating position and applying container-suspending force to the raised portion does not disturb the connection of the surrounding structure of the support with the upper formation of the predetermined container with its contents.

2. The support of claim 1 in which the at least one suspending element extends as an elongated cantilever from its at least one root to a free terminal end.

3. The support of claim 2 in which there is a single suspending element, the suspending element is a finger suspender having an axis of elongation and comprising at least one flexible root extending along said axis of elongation, a main body of substantially greater extent than the root along said axis, and a free terminal end shaped to receive a supporting finger.

4. The support of claim 3, in which said main body comprises an elongated leg portion, the free terminal end comprising a head defining a finger engageable formation.

5. The support of claim 4, in which said leg portion is of lesser lateral extent than said head.

6. The support of claim 3, the finger suspender being of sheet form and said finger engageable formation comprising an opening in the free terminal end of said finger suspender sized to receive a finger.

7. The support of claim 2 in which the suspending element defines at least two finger engageable formations, a first of said formations being spaced closer to the at least one root of the suspending element than a second of said formations.

8. The support of claim 2 in which said cantilever suspending element is at least two inches long.

9. The support of claim 2 in which the suspending element has a length exceeding one half a lateral dimension of the surrounding structure.

10. The support of claim 1 combined with a predetermined container, in which the surrounding structure of the support is constructed to interfit with an upper formation of the container that extends about a top portion that is open or constructed to be opened.

11. The combination of claim 10, the container having an upstanding wall extending from a bottom to an upper formation defining a wide mouth at the top of the container, the mouth being about as wide as the maximum horizontal cross-section of the container and greater than 5 cm (two inches) minimum dimension surrounding structure of the support extending over and removably engaged with the upper formation of the container.

12. The combination of claim 11 wherein the upper formation of the container is engaged by the surrounding structure of the support by snap fit, and the-at least one suspending element being constructed and arranged to enable the container to be suspended for display and transport by the finger of a hand.

13. The combination of claim 10 forming a package which includes contents comprising food in the form of one of dried soup, cereal, spice, grains, legumes, dried fruits, cookies, crackers, coffee in bean or ground form, nuts, snacks, popcorn, candy, yogurt, ice cream, butter, frozen juice concentrate, cheese dip and condiment.

14. The combination of claim 10 forming a package which includes contents comprising tennis balls.

15. The combination of claim 10 forming a package which includes contents comprising wrapped chocolate truffles.

16. The combination of claim 10 forming a package, wherein the container is of thermally insulated construction, the package including hot or cold contents in the form of one of hot soup, hot coffee, cold drink, ready-to-eat food, ice cream or yogurt in single serving or a larger quantity.

17. The combination of claim 10 forming a package which includes contents comprising hardware supplies or light bulbs.

18. The combination of claim 10 forming a package which includes contents and including a tamper-evident feature.

19. The package of claim 18 wherein said tamper-evident feature is a portion of heat shrunk film disposed about said-surrounding structure of the support and the-upper formation of the container.

20. The package of claim 18 in which the support is constructed to permit visibility of a mouth defined by the upper formation of the container and a tamper-evident feature is a closure of the mouth of the container visible through the support.

21. The combination of claim 10 forming a package wherein the support is constructed to permit vision of contents through a mouth defined by the upper formation of the container.

22. The combination of claim 10 forming a package containing contents, in combination with a display device, the package being suspended by its at least one suspending element on the display device.

23. The combination of claim 10 forming a package in combination with a display device, wherein the display device is disposed at an elevated location relative to a customer location, the package being constructed to hang from the display device by a said suspending element of the support at a tilt angle, said package hanging by the suspending element at said tilt angle from the elevated location relative to the customer location such that the tilt angle so situates the side of the container that it face the customer location for notice or reading of print on the side of the package.

24. The combination of claim 10 forming a package containing contents, in combination with a display device, wherein the display device is disposed at a location below eye level relative to a customer location, the package being constructed to hang from the display device by a said suspending element of the support at a tilt angle, said package hanging by the suspending element at said tilt angle at the location below eye level relative to the customer location, such that the tilt angle tilts the top of the container toward-the customer location for notice or reading of print on the top of the package.

25. The combination of claim 10 in which the container has an upstanding wall of a packaging material selected from the group consisting of molded plastic resin, resinous foam, and paper.

26. The combination of claim 10 wherein the support has a depending skirt that is heat-shrunk about the upper formation of the container to form an exterior seal.

27. The combination of claim 10 wherein there is a clear plastic film member that extends across the container to define a viewing window, the film member having a skirt that depends past, and is heat sealed in the region of the upper formation of the container.

28. The support of claim 1 comprising a molded unit.

29. The support of claim 1 wherein the at least one root is joined directly to-the surrounding structure.

30. The-support of claim 1 in which the suspending element is constructed and arranged to provide container-suspending force that is off center to the surrounding structure to impart a substantial tilt to the container when the container is supported by the suspending element.

31. The support of claim 1 in which the suspending element is molded monolithically with the surrounding structure.

32. The support of claim 1 in which the surrounding structure is part of an overcap or lid for the predetermined container.

33. The support of claim 1 in which the suspending element is joined directly, asymmetrically to said surrounding structure.

34. The support of claim 33, in which said suspending element is a finger suspender joined to said surrounding structure at a single root.

35. The support of claim 33 in which said suspending element is joined to said surrounding structure at a plurality of spaced apart roots.

36. The support of claim 35 in which said suspending element is a finger suspender.

37. The support of claim 35 in which said suspending element is a flexible bail joined asymmetrically to said supporting structure.

38. The support of claim 1 comprising two of said flexible suspending elements, the suspending elements joined at respective roots to the supporting structure, the free portions of the suspending elements comprising formations that have a range of movement that enables them to be engaged and supported together by a finger.

39. The support of claim 38 wherein, in their as-formed position, the flexible suspending elements are substantially planar finger suspenders that lie in nested relationship.

40. The support of claim 1 in which the surrounding structure is constructed to have a snap fit relationship with the upper formation of the container.

41. The support of claim 1 in which the surrounding structure is constructed to have a friction fit with the upper formation of the container.

42. The support of claim 1 in which the suspending element is constructed and adapted to be interfit with another suspending element of like construction, the suspending element having a free terminal end in the form of a head defining an opening, the head of said suspending element of a size that can be threaded through the opening of said suspending element to enable containers having said supports of like construction to be strung together.

43. The support of claim 42, in which the opening in the head includes a head-passage slot.

44. The support of claim 1 in which the surrounding structure has an opening in its center region for viewing the contents of the container.

45. The support of claim 44 combined with a clear plastic film or sheet sized and constructed to extend across the upper formation of the predetermined container.

46. The support of claim 1 combined with a said predetermined container, in which the surrounding structure of the support is connected with the upper formation of the container at a connected region and a heat shrunk band of plastic is engaged about the exterior of the connected region, engaging upon both the surrounding structure of the support and the container.

47. The support of claim 1 in combination with a clear film, foil or opaque closure element constructed to seal an opening within the upper formation of the predetermined container.

48. The support of claim 1 in which a preformed closure element insert is supported by the surrounding structure of the support, forming a lid or overcap for the predetermined container.

49. The support of claim 48 combined with a said predetermined container, the container having a mouth opening within its upper formation, and in which said closure element insert is larger than the opening of the mouth of the container and arranged to be compressed against an outer edge of the upper formation of the container to form a seal.

50. The support of claim 48 in which said closure element insert is joined to an underside of said surrounding structure.

51. The support of claim 50 in which said closure element insert is adhesively joined to said underside of said surrounding structure.

52. The support of claim 48 in which said closure element is snap fit with respect to a support flange molded on the inside of the surrounding structure.

53. The support of claim 1 in the form of an overcap or lid in which the suspending element within the surrounding structure lies over a central closure portion supported by the structure, the support comprising a pre-formed insert, the supporting structure molded about and bonded to a peripheral portion of the insert as the result of insert injection molding, a part of said support within the surrounding structure being a monolithic molded extension of the molded structure, and a part of said support within the surrounding structure being defined by the pre-formed insert, a selected surface portion of the insert bearing a release varnish preventing bonding of the free portion of the suspending element to the central closure portion that lies below the suspending element.

54. A support constructed to be connected with a predetermined container of the type having an upper rim formation surrounding a top portion, the support comprising a ring portion constructed to extend over and connect with the upper rim formation of the container to suspend the container with its contents, the ring portion being shallow, having an axial dimension substantially less than its diameter, and a flexible suspending element constructed and arranged to support the ring portion and, thereby, the container, the suspending element having an as-formed position in which the suspending element extends inwardly of, and generally within, the ring portion from a flexible proximal region that is joined to the ring portion to a free distal portion, the free distal portion arranged to be lifted by flexing of the suspending element from the as-formed position to a raised operating position for engagement by a carrier, thereby to suspend the container by its upper rim formation in a position below the carrier for display or transport, the suspending element and the ring portion being so cooperatively related that lifting the distal portion of the suspending element relative to the ring portion to raised operating position and applying container-suspending force to the raised distal portion does not disturb the connection of the shallow ring portion of the support with the upper rim formation of the predetermined container with its contents.

55. A support constructed to be connected with a predetermined container having a generally upstanding upper rim formation of at least 5 cm (two inches) diameter, the support comprising a ring portion of at least 5 cm (two inches) diameter, constructed to extend over and connect with snap fit about the rim formation to suspend the container with its contents, the ring portion being shallow, having an axial dimension substantially less than its diameter, and a single flexible suspending element constructed and arranged to support the ring portion and, thereby, the container, the suspending element having length greater than half the distance across the ring portion, the suspending element having an as-formed, lower position in which the suspending element extends from a flexible proximal region that is joined to the ring portion to a free distal portion, the free distal portion arranged to be lifted by flexing of the suspending element from the as-formed position to a raised operating position for engagement by a carrier, thereby to suspend the container by its upper rim formation in a tilted position below the carrier for display or transport, the suspending element and the ring portion being so cooperatively related that lifting the distal portion of the suspending element relative to the ring portion to raised operating position and applying container-suspending force to the raised distal portion does not disturb the connection of the shallow ring portion of the support with the upper rim formation of the predetermined container with its contents, the suspending element being of the same material as that of the ring portion, the ring portion and suspending element being of monolithic, molded form.

56. The support of claim 55, in which the suspending element in its as-formed position, lies outside of the supporting ring portion.

57. The support of claim 56 in which the free distal portion suspending element is a free terminal end of the element which defines an opening sized to receive a finger.

58. The support of claim 1, 2 or 10 in which the at least one suspending element is of sheet form.

59. The support of claim 1, 2 or 10 in which the surrounding structure has an axis and at least one suspending element in its formed position lies parallel with and along or between parallel planes that are perpendicular to the axis and projected through upper and lower outer surfaces of said surrounding structure.

60. The support of claims 38 or 39 in which each of the suspending elements extends to a free terminal end defining a finger-engageable portion, the suspending elements having axes of extension that are curved, the finger engageable formations of the suspending elements being aligned on a first line and respective roots of said suspending elements being aligned with respect to a second line that forms a substantial angle with the first line.

61. The support of claims 48 or 49 in which the surrounding structure is a molded formation and in which said closure element insert is joined with the surrounding structure as a result of the surrounding structure being molded about a peripheral portion of the insert.

* * * * *

UNITED STATES PATENT AND TRADEMARK OFFICE

CERTIFICATE OF CORRECTION

PATENT NO. : 7,086,545 B2
APPLICATION NO. : 10/622005
DATED : August 8, 2006
INVENTOR(S) : Jeffrey T. Mannion et al.

It is certified that error appears in the above-identified patent and that said Letters Patent is hereby corrected as shown below:

On the Title page (63) and at col. 1 line 2 insert the following

--Related U.S. Application Data

Continuation-in-part (and claims the benefit of priority under 35 USC 120) of application No. 10/052,210, filed January 16, 2002; PCT Application Serial Number US02/01112, filed January 16, 2002, published as WO 02/057154 A1 and PCT Application Serial Number US03/14175, filed May 6, 2003.--

Col. 21 – Claim 13 (45) line 44 – delete "dip", insert -- dips --

Signed and Sealed this

Eighteenth Day of September, 2007

JON W. DUDAS
*Director of the United States Patent and Trademark Office*